US010547960B2

(12) United States Patent
Tokunaga et al.

(10) Patent No.: US 10,547,960 B2
(45) Date of Patent: Jan. 28, 2020

(54) AUDIO PROCESSING APPARATUS

(71) Applicant: SONY SEMICONDUCTOR SOLUTIONS CORPORATION, Kanagawa (JP)

(72) Inventors: Ryuji Tokunaga, Tokyo (JP); Hiroyuki Fukuchi, Kanagawa (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 0 days.

(21) Appl. No.: 15/505,334

(22) PCT Filed: Aug. 21, 2015

(86) PCT No.: PCT/JP2015/073464
§ 371 (c)(1),
(2) Date: Feb. 21, 2017

(87) PCT Pub. No.: WO2016/035567
PCT Pub. Date: Mar. 10, 2016

(65) Prior Publication Data

US 2017/0257720 A1 Sep. 7, 2017

(30) Foreign Application Priority Data

Sep. 1, 2014 (JP) ..... 2014-177172

(51) Int. Cl.
*H04R 5/00* (2006.01)
*H04S 3/02* (2006.01)

(52) U.S. Cl.
CPC ..... *H04S 3/02* (2013.01); *H04S 2400/03* (2013.01); *H04S 2400/07* (2013.01)

(58) Field of Classification Search
CPC ..... G10L 13/00; G10L 19/00; G10L 19/0017; G10L 19/02; G10L 19/04; G10L 19/005;
(Continued)

(56) References Cited

U.S. PATENT DOCUMENTS 5,426,702 A * 6/1995 Aarts ..... H04S 5/00 381/22
2004/0032960 A1* 2/2004 Griesinger ..... H04S 3/02 381/104

(Continued)

FOREIGN PATENT DOCUMENTS

JP 2008-509600 A 3/2008
JP 2008-535015 A 8/2008
WO 2014/007096 A1 1/2014

OTHER PUBLICATIONS

"Information Technology—Coding of Audio-Visual Objects", Part 3: Audio, ISO/IEC14496-3:2009/Amd.4:2013, Apr. 1, 2015, pp. 04.

(Continued)

*Primary Examiner* — Leshui Zhang
(74) *Attorney, Agent, or Firm* — Chip Law Group

(57) ABSTRACT

The present technology relates to an audio processing apparatus capable of downmixing 7.1-ch audio data to 2-ch audio data. A coefficient for downmixing 7.1-ch audio data to 2-ch audio data is set from a coefficient for downmixing 7.1-ch audio data to 5.1-ch audio data specified by a Moving Picture Experts Group 4 (MPEG4) audio standard and a coefficient for downmixing 5.1-ch audio data to 2-ch audio data specified by the standard, and stored in a 2-ch downmixing coefficient unit 22. A 2-ch downmixing unit 21 downmixes 7.1-ch audio data to 2-ch audio data using a coefficient stored in the 2-ch downmixing coefficient unit 22. The present technology can be applied to an audio processing apparatus.

16 Claims, 19 Drawing Sheets

(58) Field of Classification Search
CPC ..... G10L 19/008; G10L 19/18; G10L 19/24; G10L 19/167; G10L 21/0208; G10L 21/0205; G10L 19/032; G10L 19/20; G10L 19/22; G10L 19/265; H04R 5/00; H04R 5/02; H04R 3/005; H04R 3/12; H04R 25/407; H04Q 7/20; H04H 60/58; G11B 2020/00057; H04S 2420/03; H04S 2420/13; H04S 1/00; H04S 3/02; H04S 3/008; H04S 2400/03; H04S 2400/11; H04N 19/00781; H04N 19/00775; H04N 21/2368; H04N 21/4394; H04N 19/00951; H04N 19/20; H04N 21/45452; H04N 21/47205; H04N 21/23412; H04N 21/44012; H04N 21/8451; H04N 21/234309; H04N 21/234
USPC ..... 381/1, 2, 15, 16, 17–23, 302, 303, 306, 381/307, 309, 310, 311, 26, 61, 86, 91, 381/92, 94.2, 94.3, 94.4, 97, 98, 103, 11, 381/77, 80; 700/94; 704/258, 263, 237, 704/216, 217, 218, E19.005, E10.001, 704/501; 455/450
See application file for complete search history.

(56) References Cited

U.S. PATENT DOCUMENTS

2010/0324915 A1* 12/2010 Seo ..... G10L 19/008 704/500
2015/0030160 A1* 1/2015 Lee ..... H04S 7/00 381/17

OTHER PUBLICATIONS

"Information technology—Coding of audio-visual objects, Part 3: Audio", ISO/IEC14496-3:2009/Amd.4:2013 Technical Corrigendum 1, Apr. 2015, 04 pages.

* cited by examiner

-PRIOR ART-

-PRIOR ART-

FIG. 6

| d1 | d2 | a | a' | a" | β1 | β2 |
|---|---|---|---|---|---|---|
| 1 | 1 | 1 | 1 | 1 | 1 | 1 |
| 0.7071 | 1 | 1 | 0.7071 | 1 | 1.41421 | 1 |
| 0.5 | 1 | 1 | 0.5 | 1 | 2 | 1 |
| 1 | 0.7071 | 1 | 1 | 0.7071 | 1 | 1.41421 |
| 0.7071 | 0.7071 | 1 | 0.7071 | 0.7071 | 1.41421 | 1.41421 |
| 0.5 | 0.7071 | 1 | 0.5 | 0.7071 | 2 | 1.41421 |
| 1 | 0.5 | 1 | 1 | 0.5 | 1 | 2 |
| 0.7071 | 0.5 | 1 | 0.7071 | 0.5 | 1.41421 | 2 |
| 0.5 | 0.5 | 1 | 0.5 | 0.5 | 2 | 2 |
| 1 | 1 | 0.7071 | 0.7071 | 0.7071 | 1.41421 | 1.41421 |
| 0.7071 | 1 | 0.7071 | 0.5 | 0.7071 | 2 | 1.41421 |
| 0.5 | 1 | 0.7071 | 0.3536 | 0.7071 | 2.82843 | 1.41421 |
| 1 | 0.7071 | 0.7071 | 0.7071 | 0.5 | 1.41421 | 2 |
| 0.7071 | 0.7071 | 0.7071 | 0.5 | 0.5 | 2 | 2 |
| 0.5 | 0.7071 | 0.7071 | 0.3536 | 0.5 | 2.82843 | 2 |
| 1 | 0.5 | 0.7071 | 0.7071 | 0.3536 | 1.41421 | 2.82843 |
| 0.7071 | 0.5 | 0.7071 | 0.5 | 0.3536 | 2 | 2.82843 |
| 0.5 | 0.5 | 0.7071 | 0.3536 | 0.3536 | 2.82843 | 2.82843 |
| 1 | 1 | 0.5 | 0.5 | 0.5 | 2 | 2 |
| 0.7071 | 1 | 0.5 | 0.3536 | 0.5 | 2.82843 | 2 |
| 0.5 | 1 | 0.5 | 0.25 | 0.5 | 4 | 2 |
| 1 | 0.7071 | 0.5 | 0.5 | 0.3536 | 2 | 2.82843 |
| 0.7071 | 0.7071 | 0.5 | 0.3536 | 0.3536 | 2.82843 | 2.82843 |
| 0.5 | 0.7071 | 0.5 | 0.25 | 0.3536 | 4 | 2.82843 |
| 1 | 0.5 | 0.5 | 0.5 | 0.25 | 2 | 4 |
| 0.7071 | 0.5 | 0.5 | 0.3536 | 0.25 | 2.82843 | 4 |
| 0.5 | 0.5 | 0.5 | 0.25 | 0.25 | 4 | 4 |

-PRIOR ART-

FIG. 14

| b | e1 | e2 | a' | a" | β11 | β |
|---|---|---|---|---|---|---|
| 1 | 1 | 1 | 2 | 1 | 0.57735 | 0.4804 |
| 0.7071 | 1 | 1 | 1.4142 | 0.7071 | 0.8165 | 0.6547 |
| 0.5 | 1 | 1 | 1 | 0.5 | 1.1547 | 0.866 |
| 1 | 0.7071 | 1 | 1.7071 | 0.7071 | 0.8165 | 0.5549 |
| 0.7071 | 0.7071 | 1 | 1.2071 | 0.5 | 1.1547 | 0.7473 |
| 0.5 | 0.7071 | 1 | 0.8536 | 0.3536 | 1.63299 | 0.9704 |
| 1 | 0.5 | 1 | 1.5 | 0.5 | 1.1547 | 0.6222 |
| 0.7071 | 0.5 | 1 | 1.0607 | 0.3536 | 1.63299 | 0.8281 |
| 0.5 | 0.5 | 1 | 0.75 | 0.25 | 2.3094 | 1.0565 |
| 1 | 1 | 0.7071 | 1.7071 | 1 | 0.57735 | 0.5549 |
| 0.7071 | 1 | 0.7071 | 1.2071 | 0.7071 | 0.8165 | 0.7473 |
| 0.5 | 1 | 0.7071 | 0.8536 | 0.5 | 1.1547 | 0.9704 |
| 1 | 0.7071 | 0.7071 | 1.4142 | 0.7071 | 0.8165 | 0.6547 |
| 0.7071 | 0.7071 | 0.7071 | 1 | 0.5 | 1.1547 | 0.866 |
| 0.5 | 0.7071 | 0.7071 | 0.7071 | 0.3536 | 1.63299 | 1.0954 |
| 1 | 0.5 | 0.7071 | 1.2071 | 0.5 | 1.1547 | 0.7473 |
| 0.7071 | 0.5 | 0.7071 | 0.8536 | 0.3536 | 1.63299 | 0.9704 |
| 0.5 | 0.5 | 0.7071 | 0.6036 | 0.25 | 2.3094 | 1.1973 |
| 1 | 1 | 0.5 | 1.5 | 1 | 0.57735 | 0.6222 |
| 0.7071 | 1 | 0.5 | 1.0607 | 0.7071 | 0.8165 | 0.8281 |
| 0.5 | 1 | 0.5 | 0.75 | 0.5 | 1.1547 | 1.0565 |
| 1 | 0.7071 | 0.5 | 1.2071 | 0.7071 | 0.8165 | 0.7473 |
| 0.7071 | 0.7071 | 0.5 | 0.8536 | 0.5 | 1.1547 | 0.9704 |
| 0.5 | 0.7071 | 0.5 | 0.6036 | 0.3536 | 1.63299 | 1.1973 |
| 1 | 0.5 | 0.5 | 1 | 0.5 | 1.1547 | 0.866 |
| 0.7071 | 0.5 | 0.5 | 0.7071 | 0.3536 | 1.63299 | 1.0954 |
| 0.5 | 0.5 | 0.5 | 0.5 | 0.25 | 2.3094 | 1.3093 |

FIG. 18

| f1 | f2 | β21 | β22 |
|---|---|---|---|
| 1 | 1 | 1 | 1 |
| 0.7071 | 1 | 1.41421 | 1 |
| 0.5 | 1 | 2 | 1 |
| 1 | 0.7071 | 1 | 1.4142 |
| 0.7071 | 0.7071 | 1.41421 | 1.4142 |
| 0.5 | 0.7071 | 2 | 1.4142 |
| 1 | 0.5 | 1 | 2 |
| 0.7071 | 0.5 | 1.41421 | 2 |
| 0.5 | 0.5 | 2 | 2 |
| 1 | 1 | 1 | 1 |
| 0.7071 | 1 | 1.41421 | 1 |
| 0.5 | 1 | 2 | 1 |
| 1 | 0.7071 | 1 | 1.4142 |
| 0.7071 | 0.7071 | 1.41421 | 1.4142 |
| 0.5 | 0.7071 | 2 | 1.4142 |
| 1 | 0.5 | 1 | 2 |
| 0.7071 | 0.5 | 1.41421 | 2 |
| 0.5 | 0.5 | 2 | 2 |
| 1 | 1 | 1 | 1 |
| 0.7071 | 1 | 1.41421 | 1 |
| 0.5 | 1 | 2 | 1 |
| 1 | 0.7071 | 1 | 1.4142 |
| 0.7071 | 0.7071 | 1.41421 | 1.4142 |
| 0.5 | 0.7071 | 2 | 1.4142 |
| 1 | 0.5 | 1 | 2 |
| 0.7071 | 0.5 | 1.41421 | 2 |
| 0.5 | 0.5 | 2 | 2 |

AUDIO PROCESSING APPARATUS

CROSS REFERENCE TO RELATED APPLICATIONS

This application is a U.S. National Phase of International Patent Application No. PCT/JP2015/073464 filed on Aug. 21, 2015, which claims priority benefit of Japanese Patent Application No. JP 2014-177172 filed in the Japan Patent Office on Sep. 1, 2014. Each of the above-referenced applications is hereby incorporated herein by reference it its entirety.

TECHNICAL FIELD

The present technology relates to an audio processing apparatus, and relates particularly to an audio processing apparatus capable of appropriately converting 7.1-ch audio data into 2-ch audio data.

BACKGROUND ART

In an MPEG4 audio standard (ISO/IEC 14496-3:2009/Amd 4:2013), a description method of 7.1-ch Advanced Audio Coding (AAC) and a downmixing method for reducing the number of channels are standardized (for example, see Non-Patent Document 1).

CITATION LIST

Non-Patent Document

Non-Patent Document 1: ISO/IEC 14496-3:2009/Amd 4:2013

SUMMARY OF THE INVENTION

Problems to be Solved by the Invention

In the above-described standard, however, although a downmixing method for converting 7.1-ch audio data into 5.1 ch is defined, a method for downmixing 7.1-ch audio data to 2-ch audio data is not defined.

For this reason, it is necessary to apply a conventional downmixing method for converting 5.1-ch audio data into 2 ch. In other words, in order to downmix 7.1-ch audio data to 2-ch audio data, it is necessary to downmix the 7.1-ch audio data to 5.1-ch audio data on the basis of the standard, and to further downmix the 5.1-ch audio data thus downmixed to the 2-ch audio data.

As a result, the process becomes cumbersome, and in addition, a total power amount, a power ratio between channels, or a localization position after downmixing in the audio data may be changed and thereby there may be a case where the 7.1-ch audio data cannot be appropriately downmixed to the 2-ch audio data.

The present technology makes it possible to directly convert 7.1-ch audio data into 2-ch audio data and to adjust a total power amount to be appropriate, the same amount as that before downmixing.

Solutions to Problems

An audio processing apparatus according to a first aspect of the present technology includes a coefficient unit and a conversion unit. The coefficient unit stores a coefficient for directly downmixing audio data corresponding to a 7.1-ch speaker system to audio data corresponding to the 2-ch speaker system, specified by a Moving Picture Experts Group 4 (MPEG4) audio standard. The conversion unit directly downmixes, using the coefficient stored in the coefficient unit, the audio data corresponding to the 7.1-ch speaker system to the audio data corresponding to the 2-ch speaker system.

The MPEG4 audio standard may be ISO/IEC 14496-3:2009/Amd 4:2013.

The coefficient can include a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system. The conversion unit can be configured to directly downmix, using the third coefficient stored in the coefficient unit, the audio data corresponding to the 7.1-ch speaker system to the audio data corresponding to the 2-ch speaker system.

The conversion unit can be configured to directly downmix the audio data corresponding to the 7.1-ch speaker system to the audio data corresponding to the 2-ch speaker system by making the sum of power and a power ratio between channels in the audio data corresponding to the 7.1-ch speaker system and the sum of power and a power ratio between channels in the audio data corresponding to the 2-ch speaker system equal, respectively.

The 7.1-ch speaker system may be 7.1-ch back.

The conversion unit can be configured to set a scaling coefficient which makes the sum of power and a power ratio between channels in the audio data corresponding to the 7.1-ch speaker system and the sum of power and a power ratio between channels in the audio data corresponding to the 2-ch speaker system equal, respectively, to make the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and to directly downmix the audio data corresponding to the 7.1-ch speaker system to the audio data corresponding to the 2-ch speaker system.

The scaling coefficient can include a first scaling coefficient which adjusts power of audio data output from a rear surround speaker.

The scaling coefficient can include a first scaling coefficient which adjusts power of audio data output from a rear surround speaker, and a second scaling coefficient which adjusts power of audio data output from a surround speaker.

The 7.1-ch speaker system may be 7.1-ch front.

The conversion unit can be configured to directly downmix the audio data corresponding to the 7.1-ch speaker system to the audio data corresponding to the 2-ch speaker system such that the sum of power and a power ratio between channels in the audio data corresponding to the 7.1-ch speaker system and the sum of power and a power ratio between channels in the audio data corresponding to the 2-ch speaker system are made equal, respectively.

The coefficient unit can be configured to include a coefficient unit which stores a coefficient for directly downmixing the audio data corresponding to the 7.1 ch-speaker system to the audio data corresponding to the 2-ch speaker system, in accordance with an arrangement of speakers which constitute the 7.1-ch front, such that the sum of power and the power ratio between channels in the audio data corresponding to the 7.1-ch speaker system and the sum of power and the power ratio between channels in the audio data corresponding to the 2-ch speaker system are made equal, respectively. The conversion unit can be configured to directly downmix, using the coefficient stored in the coefficient unit, the audio data corresponding to the 7.1-ch speaker system to the audio data corresponding to the 2-ch speaker system such that the sums of power and the power ratios between channels are respectively made equal therebetween.

The coefficient unit can be configured to store a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system. The conversion unit can be configured to directly downmix, using the third coefficient stored in the coefficient unit, the audio data corresponding to the 7.1-ch speaker system to the audio data corresponding to the 2-ch speaker system such that the sums of power and the power ratios between channels are respectively made equal therebetween.

The conversion unit can be configured to set a scaling coefficient which makes the sum of power and the power ratio between channels in the audio data corresponding to the 7.1-ch speaker system and the sum of power and the power ratio between channels in the audio data corresponding to the 2-ch speaker system equal, to make the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and to directly downmix the audio data corresponding to the 7.1-ch speaker system to the audio data corresponding to the 2-ch speaker system.

The 7.1-ch speaker system may be 7.1-ch top.

The coefficient unit can be configured to store a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system. The conversion unit can be configured to directly downmix, using the third coefficient stored in the coefficient unit, the audio data corresponding to the 7.1-ch speaker system to the audio data corresponding to the 2-ch speaker system such that the sums of power and the power ratios between channels are respectively made equal therebetween.

The conversion unit can be configured to set a scaling coefficient which makes the sum of power and the power ratio between channels in the audio data corresponding to the 7.1-ch speaker system and the sum of power and the power ratio between channels in the audio data corresponding to the 2-ch speaker system equal, respectively, to make the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and to downmix the audio data corresponding to the 7.1-ch speaker system to the audio data corresponding to the 2-ch speaker system.

An audio processing apparatus according to a second aspect of the present technology includes a first conversion unit, a second conversion unit, a first coefficient unit, and a second coefficient unit. The first conversion unit downmixes audio data corresponding to a 7.1-ch speaker system to audio data corresponding to the 5.1-ch speaker system, specified by a Moving Picture Experts Group 4 (MPEG4) audio standard. The second conversion unit downmixes the audio data corresponding to the 5.1-ch speaker system downmixed by the first conversion unit to audio data corresponding to the 2-ch speaker system. The first coefficient unit stores a first coefficient for performing, when the audio data corresponding to the 5.1-ch speaker system is finally output, downmixing to the audio data corresponding to the 5.1-ch speaker system. The second coefficient unit stores a second coefficient for performing, when the audio data corresponding to the 2-ch speaker system is finally output, downmixing to the audio data corresponding to the 5.1-ch speaker system. When the audio data corresponding to the 7.1-ch speaker system is finally downmixed to the audio data corresponding to the 2-ch speaker system and output, the first conversion unit downmixes the audio data corresponding to the 7.1-ch speaker system to the audio data corresponding to the 2-ch speaker system, using the second coefficient which is stored in the second coefficient unit and makes the sum of power, a power ratio between channels, and a localization position after downmixing in the audio data corresponding to the 7.1-ch speaker system and the sum of power, a power ratio between channels, and a localization position after downmixing in the audio data corresponding to the 2-ch speaker system to be finally output equal, respectively.

The 7.1-ch speaker system may be 7.1-ch front.

In the first aspect of the present technology, a coefficient for directly downmixing audio data corresponding to a 7.1-ch speaker system to audio data corresponding to the 2-ch speaker system, specified by the Moving Picture Experts Group 4 (MPEG4) audio standard, is stored. The audio data corresponding to the 7.1-ch speaker system is directly downmixed to the audio data corresponding to the 2-ch speaker system using the stored coefficient.

In the second aspect of the present technology, a first coefficient is stored which is for performing downmixing to audio data corresponding to the 5.1-ch speaker system when the audio data corresponding to the 5.1-ch speaker system is finally output, and the second coefficient is stored which is for performing downmixing to audio data corresponding to the 5.1-ch speaker system when audio data corresponding to the 2-ch speaker system is finally output, in a case where audio data corresponding to a 7.1-ch speaker system is downmixed to audio data corresponding to the 5.1-ch speaker system, and the downmixed audio data corresponding to the 5.1-ch speaker system is downmixed to audio data corresponding to the 2-ch speaker system, which are specified by the Moving Picture Experts Group (MPEG4) audio standard. When the audio data corresponding to the 7.1-ch speaker system is finally downmixed to the audio data corresponding to the 2-ch speaker system and output, the audio data corresponding to the 7.1-ch speaker system is downmixed to the audio data corresponding to the 2-ch speaker system, using the second coefficient which makes the sum of power, a power ratio between channels, and a localization position after downmixing in the audio data corresponding to the 7.1-ch speaker system and the sum of power, a power ratio between channels, and a localization position after downmixing in the audio data corresponding to the 2-ch speaker system to be finally output equal, respectively.

The respective audio processing apparatuses according to the first aspect and the second aspect of the present technology may be independent apparatuses or blocks which function as audio processing apparatuses.

Effects of the Invention

According to an aspect of the present technology, audio data corresponding to a 7.1-ch speaker system can be appropriately downmixed to audio data corresponding to a 2-ch speaker system.

BRIEF DESCRIPTION OF DRAWINGS

FIG. 6 is a table illustrating combination examples of coefficients including scaling coefficients required for the process in FIG. 5.

FIG. 14 is a table illustrating combination examples of coefficients including scaling coefficients required for the process in FIG. 13.

FIG. 18 is a table illustrating combination examples of coefficients including scaling coefficients required for the process in FIG. 17.

MODE FOR CARRYING OUT THE INVENTION

<7.1-ch back>

Figure 1:
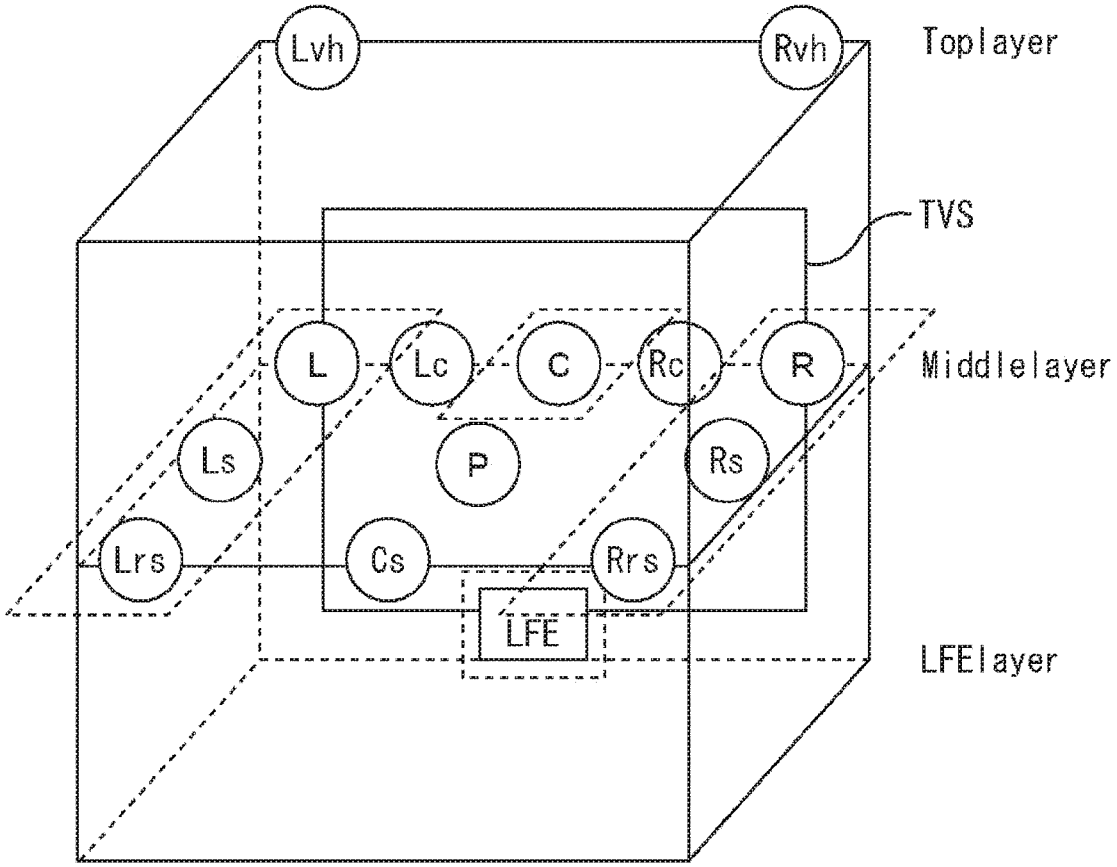
FIG. 1 is a diagram for explaining 7.1-ch back, which is a first configuration example of 7.1-ch audio data.

FIG. 1 illustrates a first configuration example of 7.1-ch audio data processed by an audio processing apparatus to which the present technology is applied.

FIG. 1 illustrates a configuration example of speakers each set for a position of a source of sound generated for a user P as a listener so as to be directly opposite to a TV screen in a display unit of a television system (TVS), which is an apparatus for displaying a video.

In other words, the arrangement of the speakers in FIG. 1 includes a top layer, a middle layer, and a low frequency effect (LFE) layer, which constitute a top-sound-part layer, a middle-sound-part layer, and a low-sound-part layer, respectively.

As illustrated in FIG. 1, the top layer includes left and right top speakers Lvh and Rvh provided at an upper right position and an upper left position, respectively, with respect to a viewing direction of the user P as a viewer.

As illustrated in FIG. 1, the middle layer includes a center speaker C, left and right speakers L and R, and left and right center speakers Lc and Rc. These speakers are provided at horizontally same positions as the position of the user P, and the center speaker C is provided at a center front position with respect to the user P to be directly opposite thereto, the left and right speakers L and R are respectively provided in front left and right directions thereof, and left and right center speakers Lc and Rc are respectively provided between the center speaker C and the left and right speakers L and R. In addition, the middle layer includes left and right surround speakers Ls and Rs respectively provided in horizontally left and right directions of the user P, left and right rear surround speakers Lrs and Rrs respectively provided at a rear right position and a rear left position with respect thereto, and a center rear surround speaker Cs provided at a center rear position with respect thereto.

As illustrated in FIG. 1, the LFE layer is constituted by a low-sound speaker LFE including a sub-woofer speaker provided at a front lower position with respect to the user P.

A 7.1-ch speaker system is constituted by a combination of six speakers arranged symmetrically which include the low-sound speaker LFE and the center speaker C among the group of speakers illustrated in FIG. 1.

For example, the 7.1-ch speaker system may be constituted by, in addition to the low-sound speaker LFE and the center speaker C surrounded by dotted lines in FIG. 1, the left and right speakers L and R, the left and right surround speakers Ls and Rs, and the left and right rear surround speakers Lrs and Rrs. It should be noted that the 7.1-ch speaker system constituted by a group of speakers surrounded by dotted lines in FIG. 1 is hereinafter referred to as 7.1-ch back.

<Conventional Conversion Method in 7.1-ch Back>

Next, with reference to FIG. 2, a conversion method will be described which is performed by an audio data converting apparatus required for converting audio data of 7.1-ch back, which is a 7.1-ch speaker system constituted by the group of speakers surrounded by dotted lines in FIG. 1, into audio data of 2 ch of the left and right speakers L and R.

Figure 2:
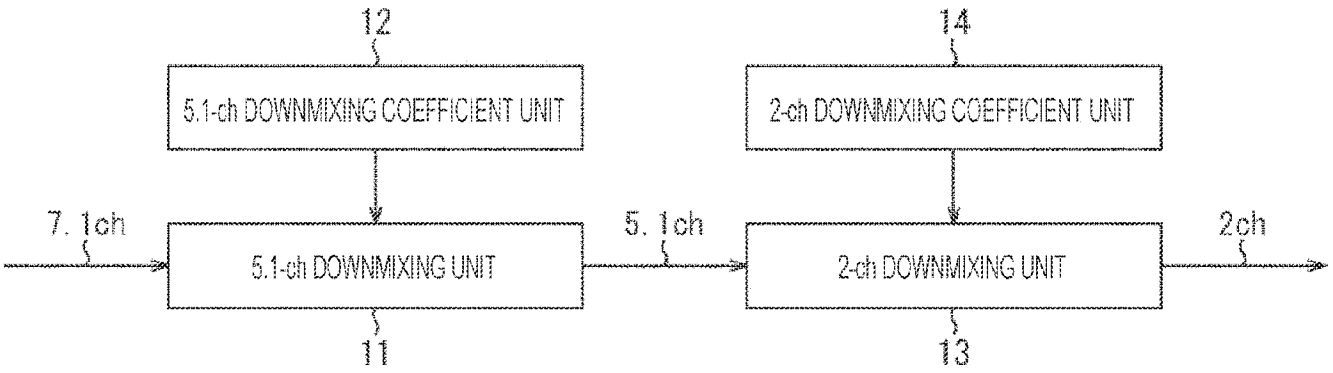
FIG. 2 is a diagram for illustrating a configuration example of a conventional audio processing apparatus.

In other words, the converting apparatus in FIG. 2 includes a 5.1-ch downmixing unit 11, a 5.1-ch downmixing coefficient unit 12, a 2-ch downmixing unit 13, and a 2-ch downmixing coefficient unit 14.

The 5.1-ch downmixing unit 11 converts 7.1-ch audio data into 5.1-ch audio data through a multiply-add operation using a coefficient stored in the 5.1-ch downmixing coefficient unit 12, and performs output to the 2-ch downmixing unit 13.

The 2-ch downmixing unit 13 converts 5.1-ch audio data into 2-ch audio data through a multiply-add operation using a coefficient stored in the 2-ch downmixing coefficient unit 14, and performs output.

Figure 3:
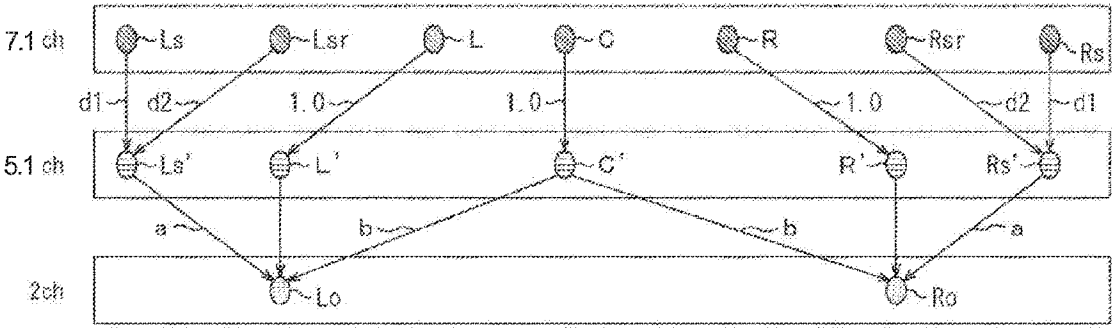
FIG. 3 is a diagram for explaining a process performed by the audio processing apparatus of FIG. 2 for downmixing 7.1-ch back audio data to 5.1-ch audio data, and further downmixing the 5.1-ch audio data to 2-ch audio data.

In a case where 7.1-ch back audio data is input as illustrated in the top portion of FIG. 3, the 5.1-ch downmixing unit 11 performs conversion, for example, into 5.1-ch audio data as illustrated in the middle portion in FIG. 3, and performs output.

Here, in FIG. 3, among audio data constituting 7.1-ch back, audio data output from the center speaker C is referred to as audio data C, and audio data output from the low-sound speaker LFE is referred to as audio data LFE. In addition, audio data output from the left and right speakers L and R are referred to as audio data L and R, respectively, audio data output from the left and right surround speakers Ls and Rs are referred to as audio data Ls and Rs, respectively, and audio data output from the left and right rear surround speakers Lsr and Rsr are referred to as audio data Lsr and Rsr, respectively.

In addition, regarding the 5.1-ch audio data converted by the 5.1-ch downmixing unit 11 on the basis of the audio data of the 7.1-ch back speaker system, audio data output from the center speaker C is referred to as audio data C', audio data output from the left and right speakers L and R are referred to as audio data L' and R', respectively, and audio data output from the left and right surround speakers Ls and Rs are referred to as audio data Ls' and Rs', respectively.

Furthermore, audio data output from the 2-ch left and right speakers L and R, which have been converted by the 2-ch downmixing unit 13 on the basis of the audio data of the 5.1-ch speaker system, are referred to as audio data Lo and Ro, respectively.

In other words, the 5.1-ch downmixing unit 11 reads a required coefficient from the 5.1-ch downmixing coefficient unit 12, and executes an operation represented by the following expression (1), thereby converting the 7.1-ch back audio data into the 5.1-ch audio data.

$$C'=C$$

$$L'=L$$

$$R'=R$$

$$Ls'=d1\times Ls+d2\times Lsr$$

$$Rs'=d1\times Rs+d2\times Rsr$$

$$LFE'=LFE \quad (1)$$

Here, C, L, R, Ls, Rs, Lsr, Rsr, and LFE are audio data respectively output from the center speaker C, the left and right speakers L and R, the left and right surround speakers Ls and Rs, the left and right rear surround speakers Lsr and Rsr, and the low-sound speaker LFE, which constitute the 7.1-ch back. In addition, C', L', R', Ls', Rs', and LFE' are audio data respectively output from the center speaker C, the left and right speakers L and R, the left and right surround speakers Ls and Rs, and the low-sound speaker LFE, which constitute the 5.1 ch. d1 and d2 are coefficients specified by ISO/IEC 14496-3:2009/Amd 4:2013.

In other words, the 5.1-ch downmixing unit 11 reads a coefficient from the 5.1-ch downmixing coefficient unit 12, and multiplies respective audio data of the center speaker C and the left and right speakers L and R by a coefficient of 1.0 to perform conversion, thereby obtaining audio data C', L', and R'. In addition, the 5.1-ch downmixing unit 11 multiplies respective audio data of the left and right surround speakers Ls and Rs and the left and right rear surround speakers Lsr and Rsr by the coefficients d1 and d2, to obtain products and sums thereof, thereby obtaining audio data Ls' and Rs' of the left and right surround speakers Ls and Rs.

By the conversion process as described above, the 7.1-ch back audio data is converted into the 5.1-ch audio data.

Furthermore, the 2-ch downmixing unit 13 reads a coefficient from the 2-ch downmixing coefficient unit 14, and performs a multiply-add operation to the 5.1-ch audio data, thereby performing conversion into 2-ch audio data. In more detail, the 2-ch downmixing unit 13 converts the 5.1-ch audio data into the 2-ch audio data through an operation represented by the following expression (2).

$$Lo=a\times Ls'+L'+b\times C'$$

$$Ro=a\times Rs'+R'+b\times C' \quad (2)$$

Here, C', L', R', Ls', and Rs' are audio data respectively output from the center speaker C, the left and right speakers L and R, and the left and right surround speakers Ls and Rs, which constitute the 5.1 ch. In addition, Lo and Ro are audio data output from the left and right speakers L and R, respectively, and are 2-ch audio data. Furthermore, a and b are coefficients specified by ISO/IEC 14496-3:2009/Amd 4:2013.

As described above, a two-stage operation process has been conventionally required for converting 7.1-ch audio data into 2-ch audio data, in which conversion into 5.1-ch audio data is first performed and then the converted 5.1-ch audio data is converted into 2-ch audio data. It should be noted that the coefficients used for the operations of the above expressions (1) and (2) are given by way of example only. For example, when forming a sound image in an acoustic space, a coefficient is a combination of various values, and therefore, a coefficient other than the above coefficients may be applied.

<First Embodiment of Converting Apparatus to which Present Technology is Applied>

Next, with reference to FIG. 4, a first embodiment of a converting apparatus to which the present technology is applied will be described.

As described above, the two-stage operation process has been conventionally required for converting 7.1-ch audio data into 2-ch audio data, in which conversion into 5.1-ch audio data is first performed and then the converted 5.1-ch audio data is converted into 2-ch audio data, and consequently, the process is cumbersome. Therefore, 7.1-ch audio data is directly converted into 2-ch audio data in the present technology.

Figure 4:
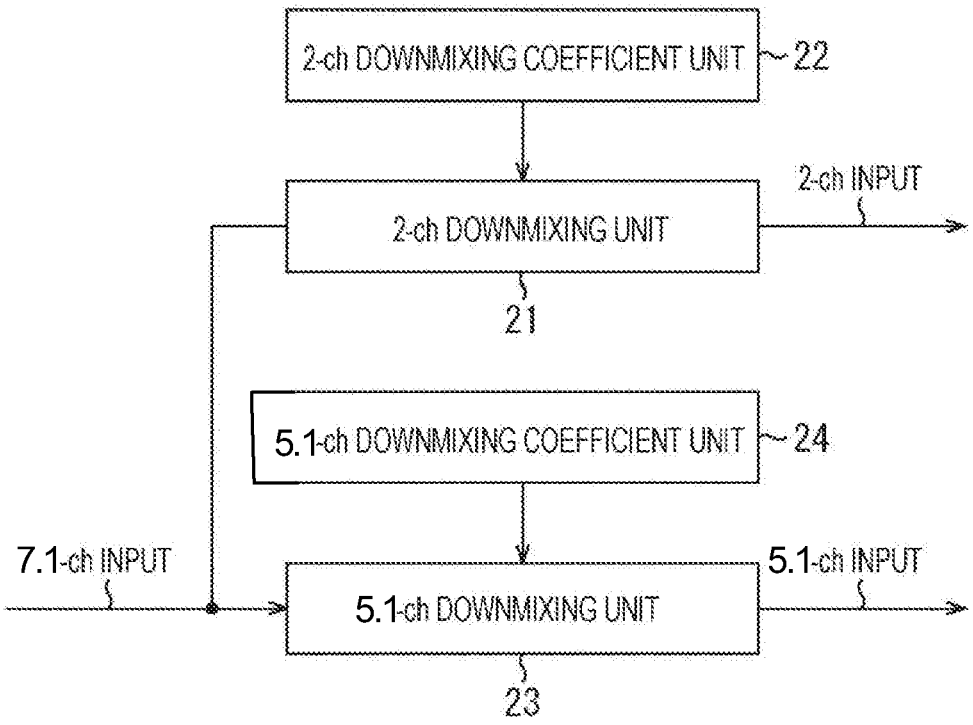
FIG. 4 is a diagram for explaining a configuration example of an audio processing apparatus to which the present technology is applied.

In more detail, the converting apparatus includes a 2-ch downmixing unit 21, a 2-ch downmixing coefficient unit 22, a 5.1-ch downmixing unit 23, and 5.1-ch downmixing coefficient unit 24, as illustrated in FIG. 4. It should be noted that since the 5.1-ch downmixing unit 23 and the 5.1-ch downmixing coefficient unit 24 are similar to the 5.1-ch downmixing unit 11 and the 5.1-ch downmixing coefficient unit 12 described with reference to FIG. 1, respectively, descriptions thereof will be omitted.

The 2-ch downmixing unit 21 reads a coefficient stored in the 2-ch downmixing coefficient unit 22, and performs a multiply-add operation to 7.1-ch audio data, thereby performing conversion into 2-ch audio data through one operation. In other words, the 7.1-ch audio data is directly downmixed to the 2-ch audio data via no 5.1-ch audio data.

Figure 5:
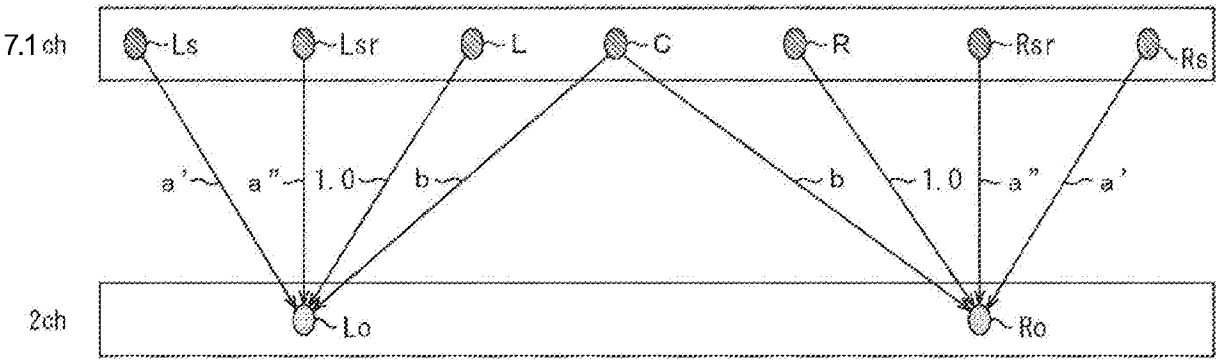
FIG. 5 is a diagram for explaining a process performed by the audio processing apparatus of FIG. 4 for downmixing 7.1-ch back audio data to 2-ch audio data.

In more detail, as illustrated in FIG. 5, the 2-ch downmixing unit 21 reads coefficients a', a", and b as coefficients stored in the 2-ch downmixing coefficient unit 22, and executes an operation represented by the following expression (3), thereby converting the 7.1-ch audio data into the 2-ch audio data.

$$Lo=a'\times Ls+a''\times Lsr+L+b\times C$$

$$Ro=a'\times Rs+a''\times Rsr+R+b\times C \tag{3}$$

Here, Lo and Ro are audio data respectively output from the left and right speakers L and R, and are 2-ch audio data. C, L, R, Ls, Rs, Lsr, and Rsr are audio data respectively output from the center speaker C, the left and right speakers L and R, the left and right surround speakers Ls and Rs, and the left and right rear surround speakers Lsr and Rsr, which constitute the 7.1-ch back.

Furthermore, the coefficients a' and a" satisfy expressions a'=a×d1 and a"=a×d2, respectively.

In other words, the operation represented by the expression (3) is obtained by substituting the expression (2) in the expression (1).

The above process makes it possible for the converting apparatus to which the present technology is applied to perform conversion into 2-ch audio data through one operation process, while two operation processes are required when converting 7.1-ch audio data into 2-ch audio data in a conventional configuration.

<First Variation>

The example has been described above in which 7.1-ch audio data is converted into 2-ch audio data through one operation by combining coefficients required for the conventional two operations. When using the operation, however, there may be a case where the sum of power and a power ratio between channels in the converted 2-ch audio data are not consistent with those of the 7.1-ch audio data before conversion.

For example, in 2-ch audio data, respective power P (Lo) and power P (Ro) of audio data Lo and Ro output from the left and right speakers are obtained through an operation as represented by the following expression (4).

$$P(Lo)=(a')^2\times(Ls)^2+(a'')^2\times(Lsr)^2+(L)^2+(b)^2\times(C)^2$$

$$P(Ro)=(a')^2\times(Rs)^2+(a'')^2\times(Rsr)^2+(R)^2+(b)^2\times(C)^2 \tag{4}$$

Accordingly, power P (All_2ch) in the 2-ch audio data satisfies the following expression (5).

$$P(\text{All_2ch}) = P(Lo) + P(Ro) = (C)^2 + (L)^2 + (R)^2 + 1/2\times(Ls)^2 + 1/2\times(Rs)^2 + 1/2\times(Lsr)^2 + 1/2\times(Rsr)^2 \tag{5}$$

Meanwhile, power P (All_7.1ch) in the 7.1-ch audio data is represented by the following expression (6).

$$P(\text{All_7.1ch})=(C)^2+(L)^2+(R)^2+(Ls)^2+(Rs)^2+(Lsr)^2+(Rsr)^2 \tag{6}$$

In other words, the power P (All_2ch) in the 2-ch audio data and the power P (All_7.1ch) in the 7.1-ch audio data are different from each other.

Therefore, a correction scaling coefficient is set such that the power P (All_2ch) in the 2-ch audio data is made equal to the power P (All_7.1ch) in the 7.1-ch audio data.

The scaling coefficient is a coefficient which makes the power P (All_2ch) in the 2-ch audio data which satisfies the above-described expression (5) consistent with the power P (All_7.1 ch) in the 7.1-ch audio data represented by the above-described expression (6).

In other words, the expression (5) is different from the expression (6) in a point that coefficients of $(Ls)^2$, $(Rs)^2$, $(Lsr)^2$, and $(Rsr)^2$ are not 1 but ½. Therefore, a scaling coefficient is set as a coefficient which adjusts the coefficient to be 1.

As indicated by the following expression (7), a scaling coefficient β1 for adjusting power of audio data of the left and right surround speakers Ls and Rs, and a scaling coefficient β2 for adjusting power of audio data of the left and right rear surround speakers Lsr and Rsr are set.

$$P(\text{All_2ch}) = P(Lo) + P(Ro) = (C)^2 + (L)^2 + (R)^2 + (\beta1)^2\times(Ls)^2 + (\beta1)^2\times(Rs)^2 + (\beta2)^2\times(Lsr)^2 + (\beta2)^2\times(Rsr)^2 \tag{7}$$

More specifically, when the coefficients d1, d2, and a change in a range of 1, 1/√2 (=0.7071), and ½ (=0.5), the scaling coefficients β1 and β2 are set as illustrated in FIG. 6. It should be noted that corresponding values of the coefficients a' and a" when the coefficients d1, d2, and a change in a range of 1, 1/√2, and ½, are also described in FIG. 6.

For example, as illustrated in FIG. 6, when all of the coefficients d1, d2, and a are 1/√2 (=0.7071), both of the scaling coefficients β1 and β2 are set to 2, and at that time, both of the coefficients a' and a" are ½ (=0.5).

By setting the scaling coefficients as described above, the 2-ch downmixing unit 21 reduces the two operation processes to one operation process and performs downmixing to 2-ch audio data in which the sum of power and a power ratio between channels are equal to the sum of power and a power ratio between channels in 7.1-ch audio data. As a result, when downmixing 7.1-ch audio data to 2-ch audio data, conventionally required two operation processes can be reduced to one operation process and downmixing can be performed while keeping the sum of power and the power ratio between channels equal to those before downmixing.

<Second Variation>

The example has been described above in which the scaling coefficients β1 and β2 are set in the left and right surround speakers Ls and Rs and the left and right rear surround speakers Lsr and Rsr, respectively, and a change in power occurring when performing downmixing to 2-ch audio data is adjusted. However, when output of the left and right rear surround speakers Lsr and Rsr provided at the rear is made equal to output of the left and right speakers L and R provided at the front, the audio is louder than the audio originally heard, due to the ear shape inherent in humans. In other words, a human ear must hear audio occurring at the rear as audio quieter than that occurring at the front.

Figure 7:
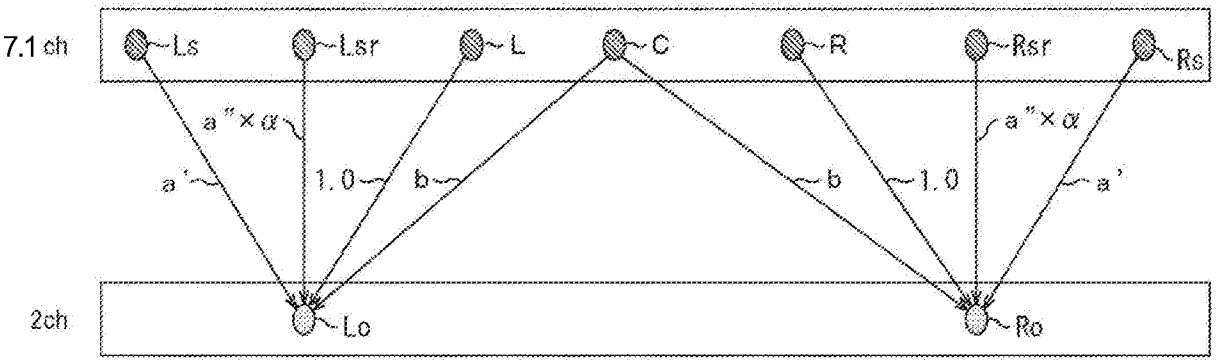
FIG. 7 is a diagram for explaining another example in which a scaling coefficient is set.

Therefore, for the purpose of adjusting the above, only a scaling coefficient α may be set as illustrated in FIG. 7. The scaling coefficient α corresponds to the scaling coefficient β2 which adjusts audio data Lsr and Rsr of the left and right rear surround speakers Lsr and Rsr provided at the rear.

By doing so, it is possible to appropriately adjust power and to downmix 7.1-ch audio data to 2-ch audio data through one operation. It should be noted that FIG. 7 illustrates that the coefficient a" is multiplied by the scaling coefficient α.

<7.1-ch front>

Figure 8:
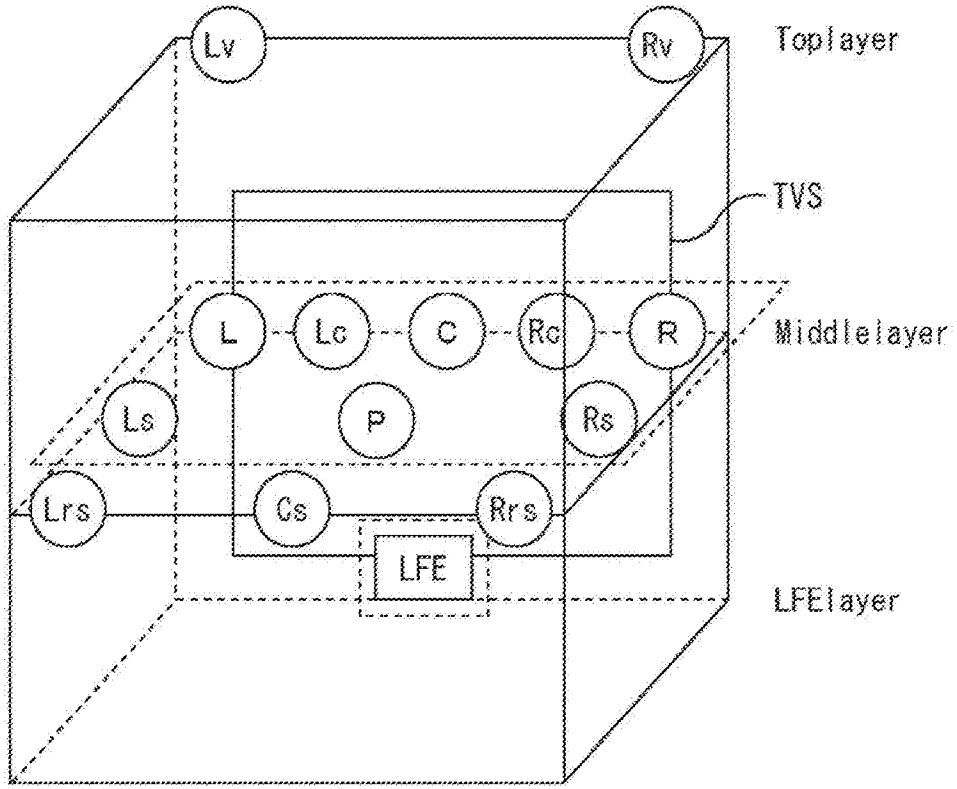
FIG. 8 is a diagram for explaining 7.1-ch front, which is a second configuration example of the 7.1-ch audio data.

The example has been described above in which 7.1-ch back audio data is converted into 2-ch audio data through one operation. However, as indicated by dotted lines in FIG. 8, 7.1-ch audio data of a speaker system including the left and right center speakers Lc and Rc instead of the left and right rear surround speakers Lsr and Rsr at the rear may be converted into 2-ch audio data. It should be noted that the speaker system as indicated by dotted lines in FIG. 8 is hereinafter referred to as 7.1-ch front.

<Conventional Conversion Method in 7.1-ch front>

Figure 9:
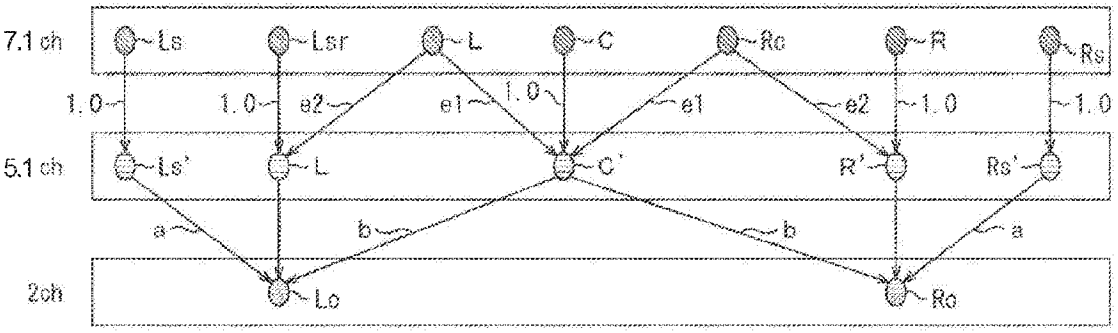
FIG. 9 is a diagram for explaining a process performed by the audio processing apparatus of FIG. 2 for downmixing 7.1-ch front audio data to 5.1-ch audio data, and further downmixing the 5.1-ch audio data to 2-ch audio data.

In that case, the 5.1-ch downmixing unit 11 converts 7.1-ch front audio data into 5.1-ch audio data as illustrated in the top portion and the middle portion in FIG. 9, by executing an operation represented by the following expression (8).

$$C'=C+(Lc+Rc)\times e1$$

$$L'=L+Lc\times e2$$

$$R'=R+Rc\times e2$$

$$Ls'=Ls$$

$$Rs'=Rs$$

$$LFE'=LFE \tag{8}$$

Here, C, L, R, Ls, Rs, Lc, Rc, and LFE are audio data respectively output from the center speaker C, the left and right speakers L and R, the left and right surround speakers Ls and Rs, the left and right center speakers Lc and Rc, and the low-sound speaker LFE, which constitute the 7.1-ch front. In addition, C', L', R', Ls', Rs', and LFE' are audio data respectively output from the center speaker C, the left and right speakers L and R, the left and right surround speakers Ls and Rs, and the low-sound speaker LFE, which constitute the 5.1 ch. Furthermore, e1 and e2 are coefficients specified by ISO/IEC 14496-3:2009/Amd 4:2013.

In other words, the 5.1-ch downmixing unit 11 reads a coefficient from the 5.1-ch downmixing coefficient unit 12, and performs an operation in which audio data of the center speaker C is multiplied by a coefficient of 1.0, the sum of audio data Lc and Rc of the left and right center speakers is obtained and multiplied by the coefficient e1, and the values thus obtained are added, thereby performing conversion into audio data C'. In addition, the 5.1-ch downmixing unit 11 reads a coefficient from the 5.1-ch downmixing coefficient unit 12, and performs an operation in which audio data of the left and right speakers L and R are multiplied by a coefficient of 1.0, respective audio data which are audio data Lc and Rc of the left and right center speakers are multiplied by the coefficient e2, and the values thus obtained are added, thereby performing conversion into audio data L' and R'. Furthermore, the 5.1-ch downmixing unit 11 multiplies respective audio data of the left and right surround speakers Ls and Rs and the low-sound speaker LFE by 1.0 as a coefficient to obtain respective audio data Ls', Rs', and LFE' of the left and right surround speakers Ls and Rs and the low-sound speaker LFE.

By the conversion process as described above, 7.1-ch front audio data is converted into 5.1-ch audio data. It should be noted that since the process for converting the 5.1-ch audio data into the 2-ch audio data illustrated in the middle portion and the lower portion in FIG. 9 is similar to that described with reference to FIG. 3, the description thereof will be omitted.

In the meantime, even when 7.1-ch front audio data is converted into 2-ch audio data by the above process, the 7.1-ch audio data and the 2-ch audio data have different power.

In other words, when 7.1-ch front audio data is converted into 5.1-ch audio data on the basis of an operation result of the expression (8), power P (All_5.1ch) thereof is obtained through an operation as represented by the following expression (9).

$$\begin{aligned}
&P(C') = C^2 + (Lc\times e1)^2 + (Rc\times e1)^2 \\
&P(L') = L^2 + (Lc\times e2)^2 \\
&P(R') = R^2 + (Rc\times e2)^2 \\
&P(Ls') = (Ls)^2 \\
&P(Rs') = (Rs)^2 \\
&P(\text{All_5.1}ch) = \\
&\quad P(C') + P(L') + P(R') + P(Ls') + P(Rs') = C^2 + L^2 + R^2 + (Ls)^2 + \\
&\quad (Rs)^2 + ((e1)^2 + (e2)^2)\times(Lc)^2 + +((e1)^2 + (e2)^2)\times(Rc)^2 = \\
&\quad C^2 + L^2 + R^2 + (Ls)^2 + (Rs)^2 + (Lc)^2 + (Rc)^2 = P(\text{All_7.1}ch)
\end{aligned} \tag{9}$$

It should be noted that both of the coefficients e1 and e2 are $1/\sqrt{2}$.

In other words, when conversion is performed to downmix 7.1-ch front audio data to 5.1 ch, there occur no change in the sum of power and a power ratio between channels.

On the other hand, when 5.1-ch audio data converted from 7.1-ch front audio data is converted into 2-ch audio data, power P (All_2ch) thereof is obtained through an operation as represented by the following expression (10). It should be noted that both of the coefficients e1 and e2 are $1/\sqrt{2}$, and the coefficient a is equal to 1.0 and the coefficient b is equal to $1/\sqrt{2}$.

$$\begin{aligned}
&Lo = a\times Ls' + L' + b\times C' = \\
&\quad a\times Ls + L + Lc\times e2 + b\times(C + (Lc - Rc)\times e1) = \\
&\quad Ls + L + (1/\sqrt{2})\times C + (1/\sqrt{2} + 1/2)\times Lc + (1/2)\times Rc \\
&Ro = a\times Rs' + R' + b\times C' = \\
&\quad a\times Rs + R + Rc\times e2 + b\times(C + (Lc - Rc)\times e1) = \\
&\quad Rs + R + (1/\sqrt{2})\times C + (1/\sqrt{2} + 1/2)\times Rc + (1/2)\times Lc \\
&P(Lo) = (Ls)^2 + L^2 + (1/2)\times C^2 + \\
&\quad (1/\sqrt{2} + 1/2)^2\times(Lc)^2 + (1/4)\times(Rc)^2 \\
&P(Ro) = (Rs)^2 + R^2 + (1/2)\times C^2 + \\
&\quad (1/\sqrt{2} + 1/2)^2\times(Rc)^2 + (1/4)\times(Lc)^2
\end{aligned} \tag{10}$$

-continued $$P(\text{All_2ch}) = P(Lo) + P(Ro) = (Ls)^2 + (Rs)^2 + L^2 + R^2 + C^2 + \left(1 + 1/\sqrt{2}\right)^2 \times (Lc)^2 + \left(1 - 1/\sqrt{2}\right) \times (Rc)^2$$

In other words, as indicated by the expression (10), it is indicated that the power increases through the conversion for downmixing 5.1-ch audio data to 2-ch audio data. In addition, it can be seen from coefficients of $(Lc)^2$ and $(Rc)^2$ being larger than 1 that the power ratio between channels is changed.

In addition, when 7.1-ch front audio data is converted into 2-ch audio data by the above technique, audio data of the left center speaker Lc is localized on audio data of the left speaker L, and audio data of the right center speaker Rc is localized on audio data of the right speaker R.

In other words, for example, power P (L to Lc) from the left speaker L to the left center speaker Lc is $(1/\sqrt{2}+1/2)^2$, whereas power P (R to Lc) from the right speaker R to the left center speaker Lc is $(1/2)^2$. Accordingly, since the power P (L to Lc) from the left speaker L to the left center speaker Lc is approximately 23 times larger than the power P (R to Lc) from the right speaker R to the left center speaker Lc, localization occurs substantially on the left speaker L.

<Second Embodiment of Converting Apparatus to which Present Technology is Applied>

Figure 10:
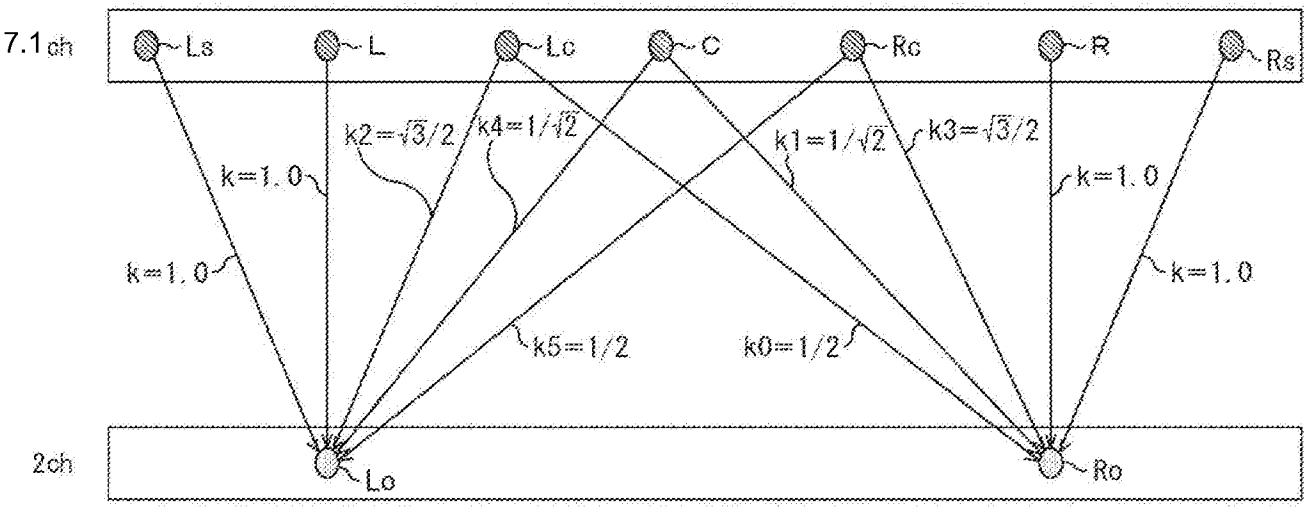
FIG. 10 is a diagram for explaining a process performed by the audio processing apparatus of FIG. 2 for downmixing 7.1-ch front audio data to 2-ch audio data.

Therefore, the 5-ch downmixing coefficient unit 24 is caused to include the same coefficients as those described above, and the 2-ch downmixing coefficient unit 22 is caused to store such coefficients as illustrated in FIG. 10, as coefficients which prevent the above-described change in power. Consequently, power can be unified even when 7.1-ch front audio data is downmixed to 5.1-ch audio data and then downmixed to 2-ch audio data. In other words, downmixing to 2-ch audio data Lt and Rt by coefficients corresponding to FIG. 10 is that represented by the following expression (11). It should be noted that since the configuration of the converting apparatus in the second embodiment of the converting apparatus to which the present technology is applied is basically the same as that in FIG. 4, the illustration thereof is omitted. However, coefficients stored in the 2-ch downmixing coefficient unit 22 are different therefrom.

$$Lt = Ls + L + k2 \times Lc + k4 \times C + k5 \times Rc$$

$$Rt = Rs + R + k3 \times Rc + k1 \times C + k0 \times Lc \quad (11)$$

Here, $k0 = k5 = 1/2$, $k1 = k4 = 1/\sqrt{2}$, and $k2 = k3 = \sqrt{3}/2$ are satisfied.

<Grounds for Deriving Coefficients k0 to k5>

Here, grounds for deriving coefficients k0 to k5 will be described.

The coefficients k0 and k2 with respect to audio data Lc of the left center speaker Lc are set so as to obtain a power ratio of 3:1 when the audio data Lc of the left center speaker Lc is mixed with audio data L and R of the left and right speakers L and R. In other words, selection is performed such that the audio data Lc of the left center speaker Lc after downmixing is localized on the same position as a reproduction position before downmixing. In other words, it is assumed that the left and right speakers L and R, the left and right center speakers Lc and Rc, and the center speaker C are each arranged at equal intervals in a vertical direction with respect to a direction directly opposite to the user P. For this reason, a power ratio is set so as to correspond at 3:1 by a ratio of physical distance.

In other words, since expressions $(k0)^2:(k2)^2=3:1$ and $(k0)^2+(k2)^2=1$ are satisfied, when the coefficients k0 and k2 are solved on the basis of the constraint, the coefficients are obtained as $k0=1/2$ and $k2=\sqrt{3}/2$.

Similarly, the coefficients k3 and k5 with respect to audio data Rc of the right center speaker Rc are set so as to obtain a power ratio of 1:3 when the audio data Rc of the right center speaker Rc is mixed with audio data L and R of the left and right speakers L and R. In other words, selection is performed such that the audio data Rc of the right center speaker Rc after downmixing is localized on the same position as a reproduction position before downmixing. In other words, it is assumed that the left and right speakers L and R, the left and right center speakers Lc and Rc, and the center speaker C are each arranged at equal intervals in a vertical direction with respect to a direction directly opposite to the user P. For this reason, a power ratio is set so as to correspond at 1:3 by a ratio of physical distance.

In other words, since expressions $(k3)^2:(k5)^2=1:3$ and $(k3)^2+(k5)^2=1$ are satisfied, when the coefficients k3 and k5 are solved on the basis of the constraint, the coefficients are obtained as $k3=\sqrt{3}/2$ and $k5=1/2$.

In addition, regarding the coefficients k4 and k1 of audio data C of the center speaker C, the coefficients are determined so as to set a power ratio such that the audio data of the center speaker C corresponds at 1:1 with respect to 2-ch left and right speakers Lt and Rt.

In other words, since expressions $(k4)^2:(k1)^2=1:1$ and $(k4)^2+(k1)^2=1$ are satisfied, when the coefficients k1 and k4 are solved on the basis of the constraint, the coefficients are obtained as $k1=1/\sqrt{2}$ and $k4=1/\sqrt{2}$.

In other words, coefficients k0 to k6 are set in accordance with the arrangement of each speaker in this example. Consequently, a change in power is prevented from occurring between before and after downmixing. As a result, it is possible to realize downmixing with good power balance in accordance with the arrangement of the speakers, while suppressing the change in power between before and after downmixing.

<Third Variation>

The conversion process has been described above in which 7.1-ch front audio data is downmixed to 2-ch audio data through one operation. However, a coefficient for converting 7.1-ch front audio data into 5.1 ch and performing output, and a coefficient for finally performing conversion into 2-ch audio data after conversion into 5.1 ch and performing output may be set separately.

Figure 11:
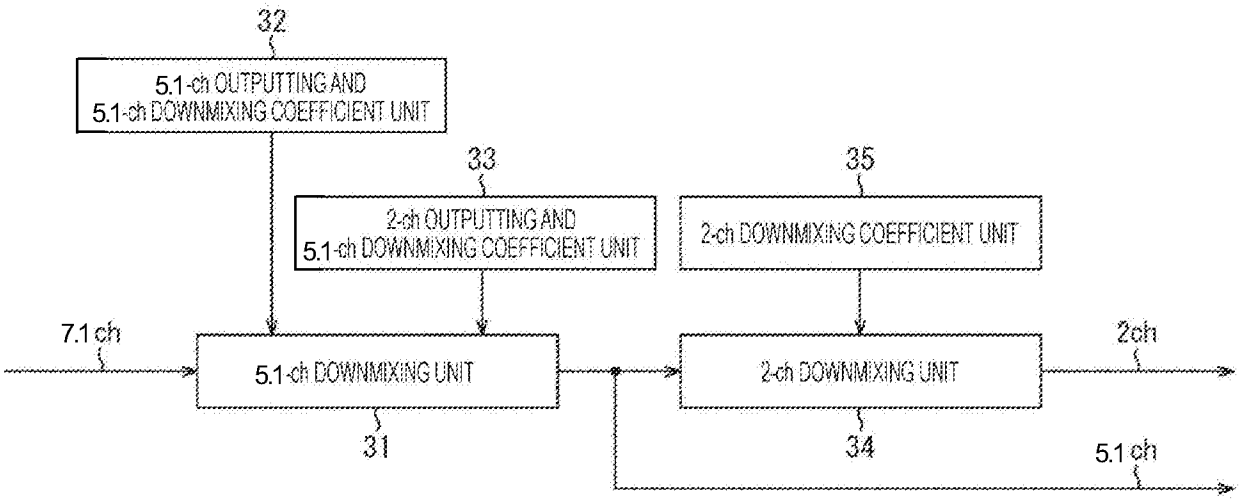
FIG. 11 is a diagram for explaining another configuration example of the audio processing apparatus to which the present technology is applied.

FIG. 11 illustrates a configuration example of a converting apparatus in which a coefficient for converting 7.1-ch front audio data into 5.1 ch and performing output, and a coefficient for finally performing conversion into 2-ch audio data after conversion into 5.1 ch and performing output are set separately.

In other words, when finally performing downmixing to 5.1-ch audio data in the converting apparatus in FIG. 11, a 5-ch downmixing unit 31 reads a coefficient stored in a 5-ch outputting and 5-ch downmixing coefficient unit 32, and downmixes 7.1-ch audio data to 5.1 ch through a multiply-add operation. In other words, the coefficient stored in the 5-ch outputting and 5-ch downmixing coefficient unit 32 is similar to a coefficient used for converting the 7.1-ch audio data in the top portion in FIG. 9 to the 5.1-ch audio data in the middle portion therein.

Alternatively, when finally performing downmixing to 2-ch audio data, the 5-ch downmixing unit 31 reads a coefficient stored in a 2-ch outputting and 5-ch downmixing coefficient unit 33, downmixes 7.1-ch audio data to 5.1 ch through a multiply-add operation, and performs output to a 2-ch downmixing unit 34.

The 2-ch downmixing unit 34 reads a coefficient for performing conversion into 2-ch audio data from a 2-ch downmixing coefficient unit 35, and downmixes the audio data downmixed from 5.1-ch to 2-ch audio data.

Figure 12:
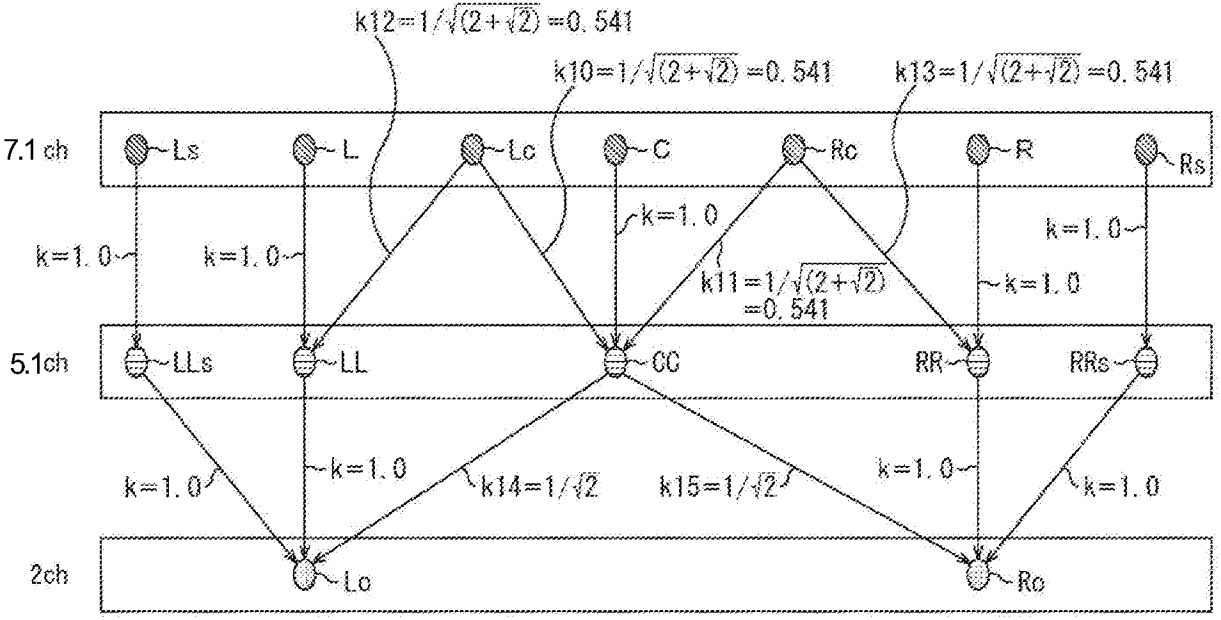
FIG. 12 is a diagram for explaining a process performed by the audio processing apparatus of FIG. 11 for downmixing 7.1-ch front audio data to 2-ch audio data.

Coefficients for finally performing downmixing to 2-ch audio data are those illustrated in FIG. 12. It should be noted that in FIG. 12, the 5.1-ch audio data are generated in a speaker system including left and right surround speakers LLs and RRs, left and right speakers LL and RR, and a center speaker CC, as illustrated in the middle portion in FIG. 12. In addition, the finally-obtained 2-ch audio data are audio data Lt and Rt output from left and right speakers Lt and Rt, respectively.

In other words, in order to make power P (All_2ch) in the left and right speakers Lt and Rt equal to power P (All_7.1ch) in 7.1-ch audio data to be input, each of coefficients K14 and K15 is set to $1/\sqrt{2}$ such that power distribution of the center speaker CC to the left and right speakers Lt and Rt becomes 1:1.

Furthermore, each of coefficients k10 and k12 is set to $1/\sqrt{(2+\sqrt{2})}$ such that power of audio data of the 7.1-ch left center speaker Lc is distributed to the 5.1-ch left speaker LL and the 5.1-ch center speaker CC at 1:1.

Similarly, each of coefficients k11 and k13 is set to $1/\sqrt{(2+\sqrt{2})}$ such that power of audio data of the 7.1-ch right center speaker Rc is distributed to the 5.1-ch right speaker RR and the 5.1-ch center speaker CC at 1:1.

As described above, coefficients for performing downmixing to 5.1 ch are switched and used in accordance with whether 7.1-ch audio data as input data is finally output as 5.1-ch audio data or as 2-ch audio data, and thereby similar power to that of 7.1-ch audio data as input data and a power balance can be obtained in any downmixing.

<Fourth Variation>

The example has been described above in which a coefficient specified by ISO/IEC 14496-3:2009/Amd 4:2013 is not used. However, the sum of power and a power ratio between channels may be adjusted to be constant by using coefficients specified by ISO/IEC 14496-3:2009/Amd 4:2013 and then setting a scaling coefficient.

Figure 13:
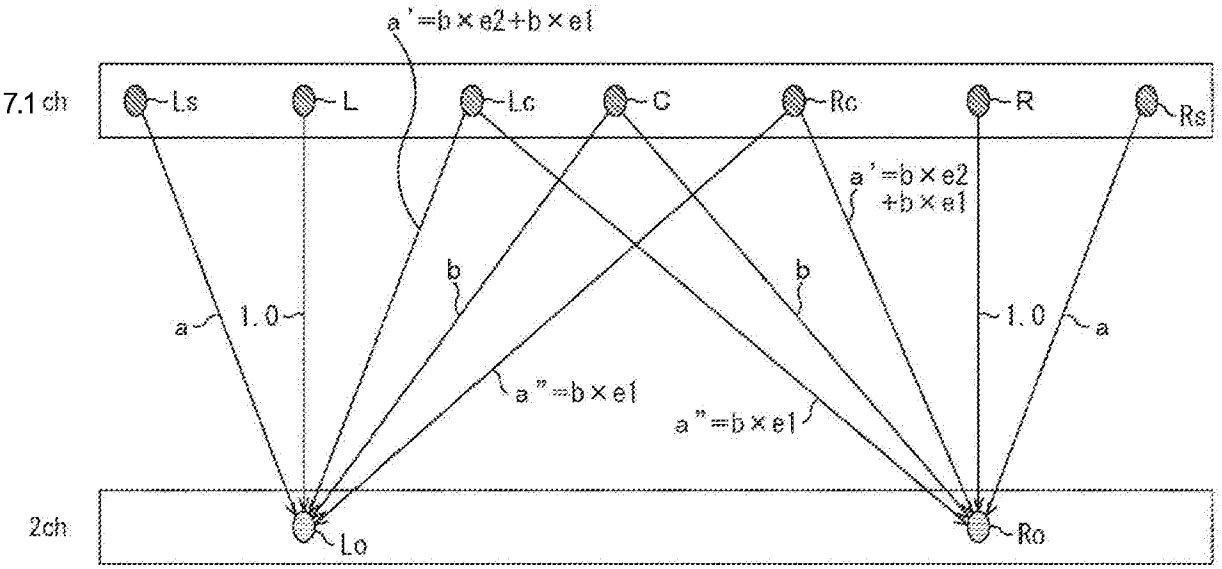
FIG. 13 is a diagram for explaining a process performed by the audio processing apparatus of FIG. 4 for downmixing 7.1-ch front audio data to 2-ch audio data.

In other words, the configuration of the converting apparatus in that case is the configuration in FIG. 4. Coefficients stored in the 2-ch downmixing coefficient unit 22 are coefficients as illustrated in FIG. 13, which are set by combining coefficients used for the two-stage conversion described referring to FIG. 9, and a relationship therebetween is represented by the following expression (12).

$$Lo=a\times Ls+L+a'\times Lc\times\beta+b\times C+a''\times Rc\times\beta$$

$$Ro=a\times Rs+R+a'\times Rc\times\beta+b\times C+a''\times Lc\times\beta \tag{12}$$

Here, the coefficient a' satisfies an expression a'=b×e2+b×e1, the coefficient a" satisfies an expression a"=b×e1, and β is a scaling coefficient.

Accordingly, when the coefficient e1=e2=b=$1/\sqrt{2}$ and a=1.0 are satisfied, for example, the audio data of left and right speakers Lo and Ro are represented by the following expression (13).

$$\begin{aligned} Lo &= a\times Ls+L+(b\times e2+b\times e1)\times Lc\times\beta+b\times C+(b\times e1)\times Rc\times\beta = \\ &\quad Ls+L+Lc\times\beta+(1/\sqrt{2})\times C+1/2\times Rc\times\beta \\ Ro &= a\times Rs+R+(b\times e2+b\times e1)\times Rc\times\beta+b\times C+ \\ &\quad (b\times e1)\times Lc\times\beta = Rs+R+Rc\times\beta+(1/\sqrt{2})\times C+1/2\times Lc\times\beta \end{aligned} \tag{13}$$

At that time, power P (Lo) and power P (Ro) are respectively represented by the following expression (14).

$$P(Lo)==(Ls)^2+L^2+(Lc)^2\times\beta^2+(½)\times C^2+¼\times(Rc)^2\times\beta^2$$

$$P(Ro)==(Rs)^2+R^2+(Rc)^2\times\beta^2+(½)\times C^2+¼\times(Lc)^2\times\beta^2 \tag{14}$$

Accordingly, as indicated by the following expression (15), the scaling coefficient β is set such that power P (All_2ch) in 2-ch audio data is made equal to power P (All_7.1ch) in 7.1-ch audio data. For example, in the case of the expression (14), the scaling coefficient β is set to be equal to $2/\sqrt{5}$ as indicated by the following expression (15).

$$\begin{aligned} P(\text{All_2}ch) &= P(Lo)+P(Ro) = \\ &\quad (Ls)^2+(Rs)^2+L^2+R^2+C^2+5/4\times(Lc)^2\times\beta^2+5/4\times(Rc)^2\times\beta^2 \end{aligned} \tag{15}$$

Consequently, an expression $5/4\times\beta^2=1$ is satisfied in order to obtain power equal to the power P (All_7.1ch) in the 7.1-ch audio data, and therefore, the scaling coefficient $\beta=2/\sqrt{5}$ is satisfied.

The above process makes it possible to perform downmixing such that the power P (All_2ch) in the 2-ch audio data is made equal to the power P (All_7.1ch) in the 7.1-ch audio data by using the scaling coefficient β even when coefficients specified by ISO/IEC 14496-3:2009/Amd 4:2013 are used.

<Fifth Variation>

The example has been described above in which the scaling coefficient β is set in the audio data of the left and right center speakers Lc and Rc. However, a scaling coefficient β11 may be further added which sets a power ratio in each audio data of the left and right center speakers Lc and Rc.

In other words, the scaling coefficient β11 is set, for example, as indicated by the following expression (16).

$$P(Lo)==(Ls)^2+L^2+(Lc)^2\times\beta^2+(½)\times C^2+¼\times(Rc)^2\times\beta^2\times(\beta11)^2$$

$$P(Ro)==(Rs)^2+R^2+(Rc)^2\times\beta^2+(½)\times C^2+¼\times(Lc)^2\times\beta^2\times(\beta11)^2 \tag{16}$$

Accordingly, power in 2-ch audio data is represented by the following expression (17).

$$\begin{aligned} P(\text{All_2}ch) &= P(Lo)+P(Ro) = (Ls)^2+(Rs)^2+L^2+R^2+C^2+ \\ &\quad (Lc)^2\times\beta^2\times(1-1/4\times(\beta11)^2)+(Rc)^2\times\beta^2\times(1+1/4\times(\beta11)^2) \end{aligned} \tag{17}$$

Consequently, an expression $\beta^2\times(1+¼\times(\beta11)^2)=1$ is satisfied in order to obtain power equal to the power P (All_7.1ch) in the 7.1-ch audio data, and therefore, when the scaling coefficient $\beta11=2/\sqrt{3}$ is satisfied, for example, the scaling coefficient $\beta=\sqrt{3}/2$ is satisfied.

In FIG. 14, combination examples of coefficients a' and a", and the scaling coefficient β when the coefficients b, e1, and e2 are 0, 1, ½, $1/\sqrt{2}$ (=0.7071) are illustrated.

With the scaling coefficient β11 set as described above, it is possible to eliminate a power change between before and after downmixing to realize downmixing with good power balance.

<7.1-ch top>

Figure 15:
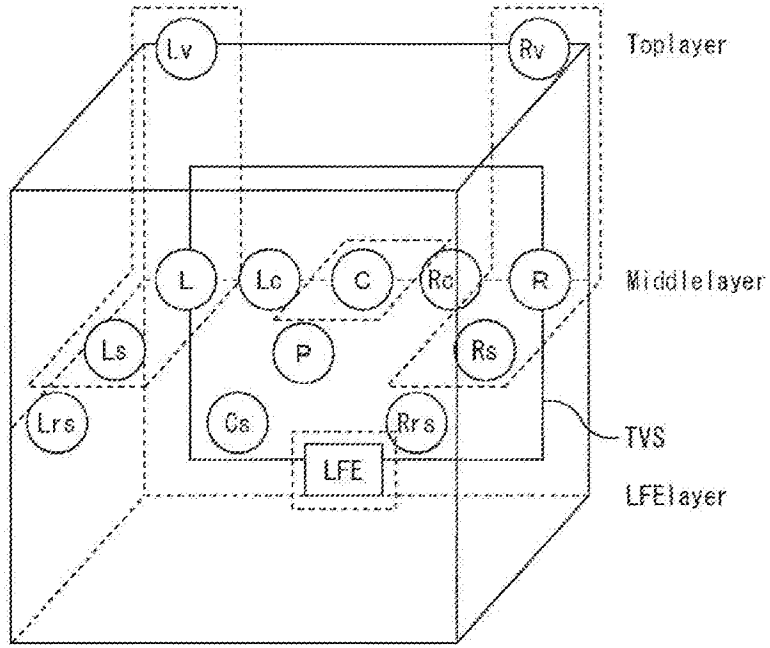
FIG. 15 is a diagram for explaining 7.1-ch top, which is a third configuration example of the 7.1-ch audio data.

The example has been described above in which audio data of a 7.1-ch front speaker system is converted into 2-ch audio data. However, audio data of a 7.1-ch speaker system including left and right top speakers Lv and Rv instead of the left and right center speakers Lc and Rc at the rear, as illustrated in dotted lines in FIG. 15, may be converted into 2-ch audio data. It should be noted that the speaker system as indicated by dotted lines in FIG. 15 is hereinafter referred to as 7.1-ch top.

<Conventional Conversion Method in 7.1-ch top>

Figure 16:
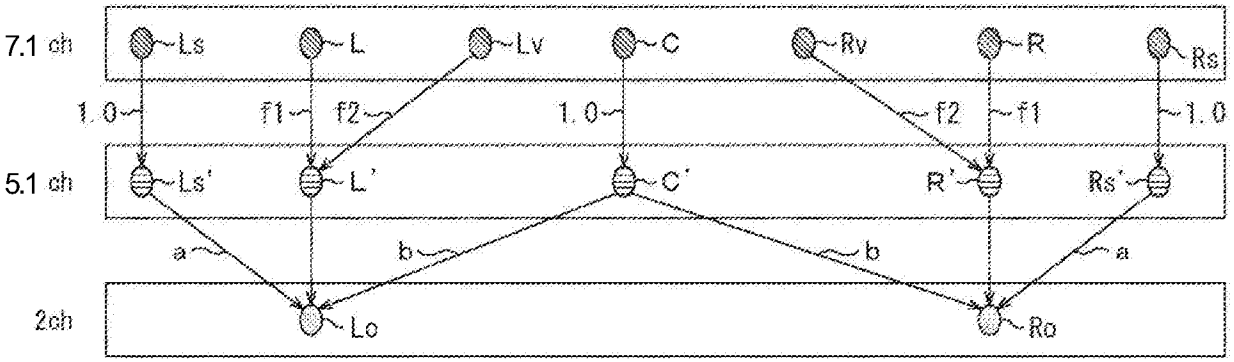
FIG. 16 is a diagram for explaining a process performed by the audio processing apparatus of FIG. 2 for downmixing 7.1-ch top audio data to 2-ch audio data.

In that case, the 5.1-ch downmixing unit 11 converts 7.1-ch top audio data into 5.1-ch audio data by executing an operation represented by the following expression (18), as illustrated in the top portion to the middle portion in FIG. 16.

$$C'=C$$

$$L'=L\times f1+Lv\times f2$$

$$R'=R\times f1+Rv\times f2$$

$$Ls'=Ls$$

$$Rs'=Rs$$

$$LFE'=LFE \tag{18}$$

Here, C, L, R, Ls, Rs, Lv, Rv, and LFE are audio data respectively output from the center speaker C, the left and right speakers L and R, the left and right surround speakers Ls and Rs, the left and right top speakers Lv and Rv, and the low-sound speaker LFE, which constitute the 7.1-ch top. In addition, C', L', R', Ls', Rs', and LFE' are audio data respectively output from the center speaker C, the left and right speakers L and R, the left and right surround speakers Ls and Rs, and the low-sound speaker LFE, which constitute the 5.1 ch. Furthermore, f1 and f2 are coefficients specified by ISO/IEC 14496-3:2009/Amd 4:2013.

In other words, the 5.1-ch downmixing unit 11 reads a coefficient from the 5.1-ch downmixing coefficient unit 12, and performs an operation by multiplying audio data of the center speaker C by a coefficient of 1.0, thereby performing conversion directly into audio data C'. In addition, the 5.1-ch downmixing unit 11 reads a coefficient from the 5.1-ch downmixing coefficient unit 12, and performs an operation in which audio data of the left and right speakers L and R are multiplied by the coefficient f1, respective audio data Lv and Rv of the left and right top speakers are multiplied by the coefficient f2, and the values thus obtained are added, thereby performing conversion into audio data L' and R'. Furthermore, the 5.1-ch downmixing unit 11 multiplies respective audio data of the left and right surround speakers Ls and Rs and the low-sound speaker LFE by 1.0 as a coefficient to obtain respective audio data Ls', Rs', and LFE' of the left and right surround speakers Ls and Rs and the low-sound speaker LFE.

By the conversion process as described above, 7.1-ch top audio data is converted into 5.1-ch audio data. It should be noted that the process for converting 5.1-ch audio data into 2-ch audio data illustrated in the middle portion and the lower portion in FIG. 16 is similar to that described with reference to FIG. 3, and represented by the following expression (19).

$$Lo=a\times Ls+f1\times L+f2\times Lv+b\times C$$

$$Ro=a\times Rs+f1\times R+f2\times Rv+b\times C \tag{19}$$

Figure 17:
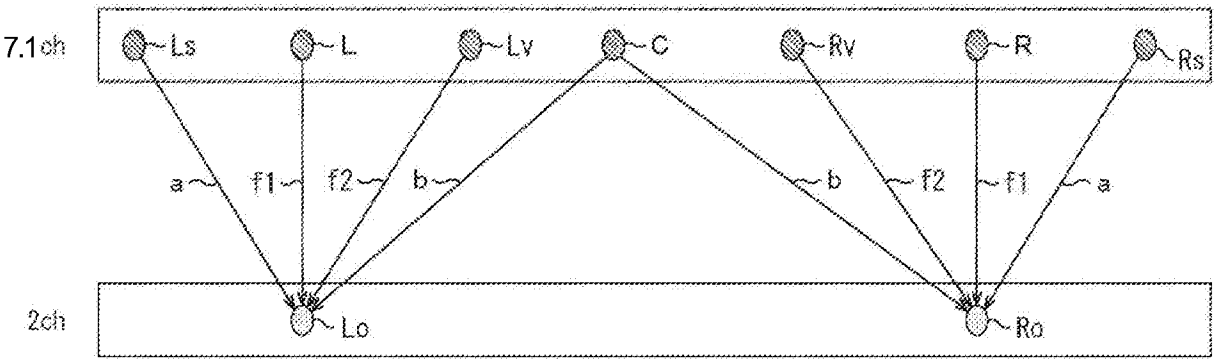
FIG. 17 is a diagram for explaining a process performed by the audio processing apparatus of FIG. 4 for downmixing 7.1-ch top audio data to 2-ch audio data.

Through the operation of the above-described expression (19), conversion is realized in which 7.1-ch audio data is downmixed to 2-ch audio data as illustrated in FIG. 17 substantially.

However, even when 7.1-ch top audio data is converted into 2-ch audio data by the above process, the sum of power and a power ratio between channels of the 7.1-ch audio data and those of the 2-ch audio data are different from each other.

In other words, when 7.1-ch front audio data is converted into 2-ch audio data on the basis of an operation result of the expression (18), power P (All_2ch) thereof is obtained through an operation as represented by the following expression (20). It should be noted that the coefficient a=1.0 and the coefficient f1=f2=b=1/√2 are satisfied here.

$$\begin{aligned} P(Lo) &= (a\times Ls)^2+(f1\times L)^2+(f1\times L)^2+(f2\times Lv)^2+(b\times C)^2 = \\ &\quad Ls^2+1/2\times L^2+1/2\times(Lv)^2+1/2\times C^2 \\ P(Ro) &= (a\times Rs)^2+(f1\times R)^2+(f2\times Rv)^2+(b\times C)^2 = \\ &\quad Rs^2+1/2\times R^2+1/2\times(Rv)^2+1/2\times C^2 \\ P(\text{All_2ch}) &= P(Lo)+P(Ro)=(Ls)^2+(Rs)^2+ \\ &\quad 1/2\times L^2+1/2\times R^2+C^2+1/2\times(Lv)^2+1/2\times(Rv)^2 \end{aligned} \tag{20}$$

In other words, as indicated by the expression (20), it is indicated that the power decreases through the conversion in which 7.1-ch audio data is downmixed to 2-ch audio data.

<Sixth Variation>

Therefore, the 5-ch downmixing unit 23 sets a correction scaling coefficient such that power P (All_2ch) in 2-ch audio data is made equal to power P (All_7.1ch) in 7.1-ch top audio data.

The scaling coefficient is a coefficient which makes the power P (All_2ch) in the 2-ch audio data which satisfies the above-described expression (20) consistent with the power P (All_7.1ch) in the 7.1-ch top audio data.

In other words, in the expression (20), a difference from the power P (All_7.1ch) in the 7.1-ch top audio data resides in a point that coefficients of $L^2$, $R^2$, $(Lv)^2$, and $(Rv)^2$ are not 1 but ½. Therefore, coefficients for adjusting the coefficients to be 1 are set.

As indicated by the following expression (21), a scaling coefficient β21 is set as a coefficient which adjusts power of audio data L and R of the left and right speakers L and R, and a scaling coefficient β22 is set as a coefficient which adjusts audio data Lv and Rv of the left and right top speakers Lv and Rv.

$$\begin{aligned} P(\text{All_2ch}) &= P(Lo)+P(Ro)=(C)^2+(\beta21)^2\times(L)^2+(\beta21)^2\times(R)^2+ \\ &\quad (Ls)^2+(Rs)^2+(\beta22)^2\times(Lv)^2+(\beta22)^2\times(Rv)^2 \end{aligned} \tag{21}$$

More specifically, when the coefficients f1 and f2 change in a range of 1, 1/√2 (=0.7071), and ½ (=0.5), the scaling coefficients β21 and β22 are set as illustrated in FIG. 18.

For example, as illustrated in FIG. 18, when both of the coefficients f1 and f2 are 1/√2 (=0.7071), both of the scaling coefficients β21 and β22 are set to √2 (=1.4142).

By setting the scaling coefficients as described above, it is possible to perform conversion into 2-ch audio data of which power is equal to power of 7.1-ch top audio data even when two operation processes are reduced to one operation process.

The above process makes it possible to realize, in any of 7.1-ch back, 7.1-ch front, and 7.1-ch top, a conversion process in which direct downmixing to 2 ch is performed through one operation via no 5.1-ch audio data, and to perform downmixing while maintaining power before the downmixing.

In the meantime, it is possible to cause not only hardware, but also software to execute the above-described series of processes. When software is caused to execute the series of processes, a program constituting the software is installed from a recording medium, in a computer incorporated in dedicated hardware, or, for example, a general-purpose personal computer capable of executing various kinds of functions by installing various kinds of programs.

Figure 19:
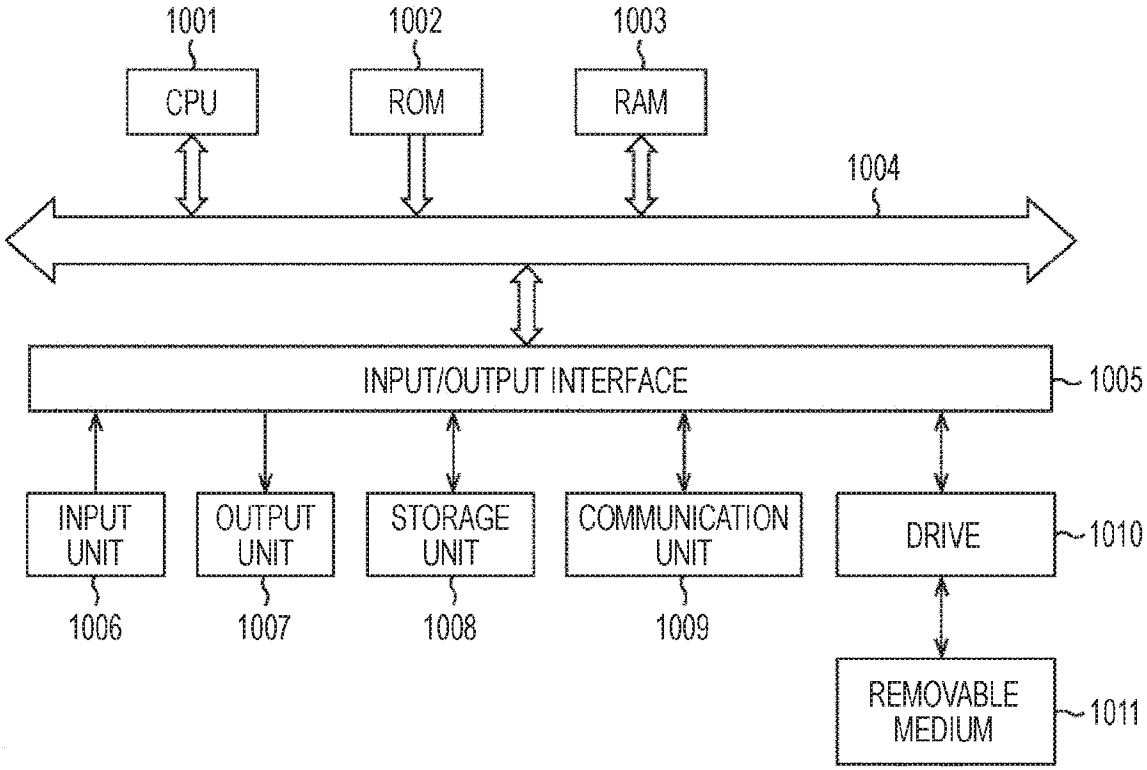
FIG. 19 is a diagram for explaining a configuration example of a general-purpose personal computer.

FIG. 19 illustrates a configuration example of a general-purpose personal computer. The personal computer includes a central processing unit (CPU) 1001. An input/output interface 1005 is connected to the CPU 1001 through a bus 1004. A read only memory (ROM) 1002 and a random access memory (RAM) 1003 are connected to the bus 1004.

An input unit 1006, an output unit 1007, a storage unit 1008, and a communication unit 1009 are connected to the input/output interface 1005. The input unit 1006 includes an input device such as a key board and a mouse with which a user inputs an operation command. The output unit 1007 outputs a processing operation screen or an image of a processing result to a display device. The storage unit 1008 includes a hard disk drive which stores a program and various kinds of data. The communication unit 1009 includes a local area network (LAN) adapter and executes a communication process through a network typified by the internet. In addition, a drive 1010 is connected thereto. The drive 1010 reads/writes data with respect to a removable medium 1011 such as a magnetic disk (including a flexible disk), an optical disc (including a compact disc-read only memory (CD-ROM), and a digital versatile disc (DVD)), a magneto-optical disc (including a mini disc (MD)), or a semiconductor memory.

The CPU 1001 executes various processes in accordance with a program stored in the ROM 1002 or a program read from the removable medium 1011 such as a magnetic disk, an optical disc, a magneto-optical disc, or a semiconductor memory, installed in the storage unit 1008, and loaded to the RAM 1003 from the storage unit 1008. In addition, the RAM 1003 appropriately stores data required for the CPU 1001 to execute various processes.

In a computer with the above configuration, the CPU 1001 loads, for example, a program stored in the storage unit 1008 to the RAM 1003 through the input/output interface 1005 and the bus 1004 to execute the program, and thereby the above-described series of processes is performed.

The program executed by the computer (CPU 1001) can be recorded, for example, in the removable medium 1011 as a package medium and provided. In addition, the program can be provided through a wired or wireless transmission medium such as a local area network, the internet, or digital satellite broadcasting.

In the computer, a program can be installed in the storage unit 1008 through the input/output interface 1005 by inserting the removable medium 1011 into the drive 1010. In addition, the program can be received by the communication unit 1009 through the wired or wireless transmission medium and installed in the storage unit 1008. Besides, the program can be installed in advance in the ROM 1002 or the storage unit 1008.

It should be noted that the program executed by the computer may be a program with which processes are performed time-sequentially along the order of description herein, or may be a program with which processes are performed in parallel or at necessary timing, for example, when a call is made.

In addition, a system as used herein means a collection of a plurality of components (such as an apparatus and a module (part)), irrespective of whether all components are included in the same housing. Accordingly, both of multiple apparatuses accommodated in separate housings and connected through a network, and one apparatus in which a plurality of modules is accommodated in one housing are systems.

It should be noted that the embodiment of the present technology is not limited to the embodiments described above. Various modifications may be made without departing from the gist of the present technology.

For example, the present technology may have a cloud computing configuration in which a plurality of apparatuses shares one function through a network, and jointly performs a process.

In addition, each step described with the above flowchart can be executed by one apparatus, and in addition, can be shared and executed by a plurality of apparatuses.

Furthermore, when a plurality of processes is included in one step, the plurality of processes included in the one step can be executed by one apparatus, and in addition, can be shared and executed by a plurality of apparatuses.

It should be noted that the present technology may have the following configurations.

(1) An audio processing apparatus including:

a coefficient unit that stores a coefficient for directly downmixing audio data corresponding to a 7.1-ch speaker system to audio data corresponding to the 2-ch speaker system, specified by a Moving Picture Experts Group 4 (MPEG4) audio standard; and a conversion unit that directly downmixes, using the coefficient stored in the coefficient unit, the audio data corresponding to the 7.1-ch speaker system to the audio data corresponding to the 2-ch speaker system.

(2) The audio processing apparatus according to (1), wherein the MPEG4 audio standard is ISO/IEC 14496-3:2009/Amd 4:2013.

(3) The audio processing apparatus according to (1), wherein the coefficient includes a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system, and the conversion unit directly downmixes, using the third coefficient stored in the coefficient unit, the audio data corresponding to the 7.1-ch speaker system to the audio data corresponding to the 2-ch speaker system.

(4) The audio processing apparatus according to (1), wherein the conversion unit directly downmixes the audio data corresponding to the 7.1-ch speaker system to the audio data corresponding to the 2-ch speaker system by making the sum of power and a power ratio between channels in the audio data corresponding to the 7.1-ch speaker system and the sum of power and a power ratio between channels in the audio data corresponding to the 2-ch speaker system equal, respectively.

(5) The audio processing apparatus according to (1), wherein the 7.1-ch speaker system is 7.1-ch back. (6) The audio processing apparatus according to (5), wherein the conversion unit sets a scaling coefficient that makes the sum of power and a power ratio between channels in the audio data corresponding to the 7.1-ch speaker system and the sum of power and a power ratio between channels in the audio data corresponding to the 2-ch speaker system equal, respectively, makes the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and directly downmixes the audio data corresponding to the 7.1-ch speaker system to the audio data corresponding to the 2-ch speaker system.

(7) The audio processing apparatus according to (6), wherein the scaling coefficient includes a first scaling coefficient that adjusts power of audio data output from a rear surround speaker.

(8) The audio processing apparatus according to (6), wherein the scaling coefficient includes a first scaling coefficient that adjusts power of audio data output from a rear surround speaker, and a second scaling coefficient that adjusts power of audio data output from a surround speaker.

(9) The audio processing apparatus according to (1), wherein the 7.1-ch speaker system is 7.1-ch front.

(10) The audio processing apparatus according to (9), wherein the conversion unit directly downmixes the audio data corresponding to the 7.1-ch speaker system to the audio data corresponding to the 2-ch speaker system such that the sum of power and a power ratio between channels in the audio data corresponding to the 7.1-ch speaker system and the sum of power and a power ratio between channels in the audio data corresponding to the 2-ch speaker system are made equal, respectively.

(11) The audio processing apparatus according to (10), wherein the coefficient unit includes a coefficient unit that stores a coefficient for directly downmixing the audio data corresponding to the 7.1 ch-speaker system to the audio data corresponding to the 2-ch speaker system, in accordance with an arrangement of speakers that constitute the 7.1-ch front, such that the sum of power and the power ratio between channels in the audio data corresponding to the 7.1-ch speaker system and the sum of power and the power ratio between channels in the audio data corresponding to the 2-ch speaker system are made equal, respectively, and the conversion unit directly downmixes, using the coefficient stored in the coefficient unit, the audio data corresponding to the 7.1-ch speaker system to the audio data corresponding to the 2-ch speaker system such that the sums of power and the power ratios between channels are respectively made equal therebetween.

(12) The audio processing apparatus according to (10), wherein the coefficient unit stores a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system, and the conversion unit directly downmixes, using the third coefficient stored in the coefficient unit, the audio data corresponding to the 7.1-ch speaker system to the audio data corresponding to the 2-ch speaker system such that the sums of power and the power ratios between channels are respectively made equal therebetween.

(13) The audio processing apparatus according to (12), wherein the conversion unit sets a scaling coefficient that makes the sum of power and the power ratio between channels in the audio data corresponding to the 7.1-ch speaker system and the sum of power and the power ratio between channels in the audio data corresponding to the 2-ch speaker system equal, respectively, makes the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and directly downmixes the audio data corresponding to the 7.1-ch speaker system to the audio data corresponding to the 2-ch speaker system.

(14) The audio processing apparatus according to (1), wherein the 7.1-ch speaker system is 7.1-ch top.

(15) The audio processing apparatus according to (14), wherein the coefficient unit stores a third coefficient for downmixing, using a first coefficient for downmixing audio data corresponding to a 7.1-ch speaker system to audio data corresponding to a 5.1-ch speaker system, specified by the Moving Picture Experts Group 4 (MPEG4) audio standard, and a second coefficient for downmixing audio data corresponding to a 5.1-ch speaker system to audio data corresponding to a 2-ch speaker system, specified by the standard, the audio data corresponding to the 7.1-ch speaker system to the audio data corresponding to the 2-ch speaker system, and the conversion unit directly downmixes, using the third coefficient stored in the coefficient unit, the audio data corresponding to the 7.1-ch speaker system to the audio data corresponding to the 2-ch speaker system such that the sums of power and the power ratios between channels are respectively made equal therebetween.

(16) The audio processing apparatus according to (15), wherein the conversion unit sets a scaling coefficient that makes the sum of power and the power ratio between channels in the audio data corresponding to the 7.1-ch speaker system and the sum of power and the power ratio between channels in the audio data corresponding to the 2-ch speaker system equal, respectively, makes the sum of power and the power ratio between channels in the audio data corresponding to the 7.1-ch speaker system and the sum of power and the power ratio between channels in the audio data corresponding to the 2-ch speaker system equal, respectively, by the scaling coefficient and the coefficient, and downmixes the audio data corresponding to the 7.1-ch speaker system to the audio data corresponding to the 2-ch speaker system.

(17) An audio processing apparatus including:

a first conversion unit that downmixes audio data corresponding to a 7.1-ch speaker system to audio data corresponding to the 5.1-ch speaker system, specified by a Moving Picture Experts Group 4 (MPEG4) audio standard;

a second conversion unit that downmixes the audio data corresponding to the 5.1-ch speaker system downmixed by the first conversion unit to audio data corresponding to the 2-ch speaker system;

a first coefficient unit that stores a first coefficient for performing, when the audio data corresponding to the 5.1-ch speaker system is finally output, downmixing to the audio data corresponding to the 5.1-ch speaker system; and a second coefficient unit that stores a second coefficient for performing, when the audio data corresponding to the 2-ch speaker system is finally output, downmixing to the audio data corresponding to the 5.1-ch speaker system, wherein when the audio data corresponding to the 7.1-ch speaker system is finally downmixed to the audio data corresponding to the 2-ch speaker system and output, the first conversion unit downmixes the audio data corresponding to the 7.1-ch speaker system to the audio data corresponding to the 2-ch speaker system, using the second coefficient that is stored in the second coefficient unit and makes the sum of power, a power ratio between channels, and a localization position after downmixing in the audio data corresponding to the 7.1-ch speaker system and the sum of power, a power ratio between channels, and a localization position after downmixing in the audio data corresponding to the 2-ch speaker system to be finally output equal, respectively.

(18) The audio processing apparatus according to (17), wherein the 7.1-ch speaker system is 7.1-ch front.

REFERENCE SIGNS LIST

21 2-ch downmixing unit
22 2-ch downmixing coefficient unit
23 5-ch downmixing unit
24 5-ch downmixing coefficient unit
31 5-ch downmixing unit
32 5-ch outputting and 5-ch downmixing coefficient unit
33 2-ch outputting and 5-ch downmixing coefficient unit
34 2-ch downmixing unit
35 2-ch downmixing coefficient unit

The invention claimed is:

1. An audio processing apparatus, comprising:

a memory configured to store a coefficient, wherein the stored coefficient is used to directly downmix 7.1-ch audio data corresponding to a 7.1-ch speaker system to 2-ch audio data corresponding to a 2-ch speaker system, and the stored coefficient is set based on coefficients specified by a Moving Picture Experts Group 4 (MPEG4) audio standard for downmix of 7.1-ch audio data to 5.1-ch audio data and downmix of 5.1-ch audio data to 2-ch audio data; and a Central Processing Unit (CPU) configured to:

set a scaling coefficient that is multiplied with the 7.1-ch audio data, such that a power ratio between channels in the 7.1-ch audio data is made equal to a power ratio between channels in the 2-ch audio data, wherein a value of the scaling coefficient is set based on values of the coefficients used to downmix 7.1-ch audio data to 5.1-ch audio data and downmix of 5.1-ch audio data to 2-ch audio data; and directly downmix the 7.1-ch audio data to the 2-ch audio data based on the coefficient stored in the memory and based on the power ratio between the channels in the 7.1-ch audio data made equal to the power ratio between the channels in the 2-ch audio data by the multiplication of the scaling coefficient with the 7.1-ch audio data.

2. The audio processing apparatus according to claim 1, wherein the MPEG4 audio standard is ISO/IEC 14496-3:2009/Amd 4:2013.

3. The audio processing apparatus according to claim 1, wherein the stored coefficient includes a third coefficient to downmix the 7.1-ch audio data to the 2-ch audio data, the third coefficient is based on a first coefficient to downmix the 7.1-ch audio data to 5.1-ch audio data corresponding to a 5.1-ch speaker system, the third coefficient is specified by the MPEG4 audio standard, the third coefficient is further based on a second coefficient to downmix the 5.1-ch audio data to the 2-ch audio data, the second coefficient is specified by the MPEG4 audio standard, and the CPU is further configured to directly downmix the 7.1-ch audio data to the 2-ch audio data based on the third coefficient.

4. The audio processing apparatus according to claim 1, wherein the CPU is further configured to directly downmix the 7.1-ch audio data to the 2-ch audio data based on a sum of power and the power ratio between the channels in the 7.1-ch audio data equal to a sum of power and the power ratio between the channels in the 2-ch audio data.

5. The audio processing apparatus according to claim 1, wherein the 7.1-ch speaker system is 7.1-ch back.

6. The audio processing apparatus according to claim 5, wherein the scaling coefficient further makes a sum of power and the power ratio between the channels in the 7.1-ch audio data equal to a sum of power and the power ratio between the channels in the 2-ch audio data, and the CPU is further configured to directly downmix the 7.1-ch audio data to the 2-ch audio data based on the scaling coefficient and the stored coefficient.

7. The audio processing apparatus according to claim 6, wherein the scaling coefficient includes a first scaling coefficient that adjusts power of first output audio data output from a rear surround speaker.

8. The audio processing apparatus according to claim 7, wherein the scaling coefficient further includes a second scaling coefficient that adjusts power of second output audio data output from a surround speaker.

9. The audio processing apparatus according to claim 1, wherein the 7.1-ch speaker system is 7.1-ch front.

10. The audio processing apparatus according to claim 9, wherein the CPU is further configured to directly downmix the 7.1-ch audio data to the 2-ch audio data based on a sum of power and the power ratio between the channels in the 7.1-ch audio data equal to a sum of power and the power ratio between the channels in the 2-ch audio data.

11. The audio processing apparatus according to claim 10, wherein the memory is further configured to store the coefficient to directly downmix the 7.1-ch audio data to the 2-ch audio data, based on an arrangement of speakers that constitute the 7.1-ch front.

12. The audio processing apparatus according to claim 10, wherein the memory is further configured to store a third coefficient to downmix the 7.1-ch audio data to the 2-ch audio data, the third coefficient is based on a first coefficient to downmix the 7.1-ch audio data to 5.1-ch audio data corresponding to a 5.1-ch speaker system, the third coefficient is specified by the MPEG4 audio standard, the third coefficient is further based on a second coefficient to downmix the 5.1-ch audio data to the 2-ch audio data, the second coefficient is specified by the MPEG4 audio standard, and the CPU is further configured to directly downmix the 7.1-ch audio data to the 2-ch audio data based on the third coefficient stored in the memory.

13. The audio processing apparatus according to claim 12, wherein the scaling coefficient further makes the sum of power and the power ratio between the channels in the 7.1-ch audio data equal to the sum of power and the power ratio between the channels in the 2-ch audio data, and the CPU is further configured to directly downmix the 7.1-ch audio data to the 2-ch audio data based on the scaling coefficient and the stored coefficient.

14. The audio processing apparatus according to claim 1, wherein the 7.1-ch speaker system is 7.1-ch top.

15. The audio processing apparatus according to claim 14, wherein the memory is further configured to store a third coefficient to downmix the 7.1-ch audio data to the 2-ch audio data, the third coefficient is based on a first coefficient to downmix the 7.1-ch audio data to 5.1-ch audio data corresponding to a 5.1-ch speaker system, the third coefficient is specified by the MPEG4 audio standard, the third coefficient is further based on a second coefficient to downmix the 5.1-ch audio data to the 2-ch audio data, the second coefficient is specified by the MPEG4 audio standard, and the CPU is further configured to directly downmix the 7.1-ch audio data to the 2-ch audio data based on the third coefficient.

16. The audio processing apparatus according to claim 15, wherein the scaling coefficient further makes a sum of power and the power ratio between the channels in the 7.1-ch audio data equal to a sum of power and the power ratio between the channels in the 2-ch audio data, and the CPU is further configured to directly downmix the 7.1-ch audio data to the 2-ch audio data based on the scaling coefficient and the stored coefficient.

* * * * *